US007195236B2

(12) United States Patent
Hillerich, Jr. et al.

(10) Patent No.: US 7,195,236 B2
(45) Date of Patent: Mar. 27, 2007

(54) AUTOMATED INDUCTION SYSTEMS AND METHODS FOR MAIL AND/OR OTHER OBJECTS

(75) Inventors: Thomas A. Hillerich, Jr., Shepherdsville, KY (US); Mark T. Neebe, Catonsville, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 425 days.

(21) Appl. No.: 10/649,337

(22) Filed: Aug. 27, 2003

(65) Prior Publication Data

US 2004/0193554 A1 Sep. 30, 2004

Related U.S. Application Data

(63) Continuation-in-part of application No. 10/400,522, filed on Mar. 28, 2003.

(60) Provisional application No. 60/469,828, filed on May 13, 2003.

(51) Int. Cl.
*B65H 5/00* (2006.01)

(52) U.S. Cl. ..... 271/2; 271/149; 414/403

(58) Field of Classification Search ..... 271/149, 271/150, 152, 154, 155, 900; 414/795.7, 414/309, 331.08, 331.18, 331.15, 271, 272, 414/277, 284, 416.05, 416.06, 416.07, 416.09, 414/403, 411

See application file for complete search history.

(56) References Cited

U.S. PATENT DOCUMENTS 4,446,962 A 5/1984 Burkhardt
4,509,635 A 4/1985 Emsley et al.
4,699,277 A 10/1987 Baxter
4,725,182 A 2/1988 Sakamoto et al.
4,730,730 A 3/1988 Clarkson
4,757,985 A 7/1988 Hamant et al.
4,863,037 A 9/1989 Stevens et al.
4,895,242 A 1/1990 Michel
5,044,877 A 9/1991 Constant et al.
5,054,992 A 10/1991 Hognestad et al.
5,104,109 A 4/1992 Kubo
5,106,254 A 4/1992 Tolasch et al.
5,119,954 A 6/1992 Svyatsky et al.
5,183,378 A 2/1993 Asano et al.
5,239,182 A 8/1993 Tateyama et al.
5,244,199 A 9/1993 Wood
5,266,812 A 11/1993 Mokuo (Continued)

*Primary Examiner*—Patrick Mackey
*Assistant Examiner*—Matthew J. Kohner
(74) *Attorney, Agent, or Firm*—Rothwell, Figg, Ernst & Manbeck

(57) ABSTRACT

In some embodiments, a system for automated loading of a side-by-side stack of thin objects to a feeder is provided. The system can include, e.g.: a) a transporter having a transport surface upon which a side-by-side stack of thin objects can be conveyed; b) a carrier, configured to carry a side-by-side stack of thin objects, over the transport surface; c) a pusher over the transport surface; d) the pusher and the carrier being movable relative to one another between a first position in which the pusher is inside the carrier behind a side-by-side stack of thin objects on the carrier and a second position in which the pusher is laterally displaced from the carrier, such that the side-by-side stack of thin objects on the carrier is laterally slid off of the carrier by the pusher.

32 Claims, 15 Drawing Sheets

U.S. PATENT DOCUMENTS 5,273,392 A 12/1993 Bernard, II et al.
5,360,316 A 11/1994 O'Mara et al.
5,364,592 A 11/1994 Lewis et al.
5,379,992 A 1/1995 Holmes et al.
5,419,457 A 5/1995 Ross et al.
5,535,874 A 7/1996 Ross et al.
5,593,269 A 1/1997 Bernard, II
5,692,867 A 12/1997 Kondo et al.
5,695,071 A 12/1997 Ross et al.
5,713,713 A 2/1998 Syde et al.
5,733,093 A 3/1998 Palm et al.
5,826,744 A 10/1998 Kwasniewski et al.
5,829,742 A 11/1998 Rabindran et al.
5,833,076 A 11/1998 Harres et al.
5,857,830 A 1/1999 Harres et al.
5,871,209 A * 2/1999 Orchard et al. ..... 271/149
5,897,290 A 4/1999 Lu et al.
5,906,468 A 5/1999 Vander Syde et al.
5,934,666 A 8/1999 Rabindran et al.
5,934,866 A 8/1999 Redden
5,947,468 A 9/1999 McKee et al.
5,957,448 A 9/1999 Frank et al.
5,964,564 A 10/1999 Hanon et al.
5,971,391 A 10/1999 Salomon et al.
5,980,188 A 11/1999 Ko et al.
5,993,132 A 11/1999 Harres et al.
6,024,533 A 2/2000 Redden
6,026,967 A 2/2000 Isaacs et al.
6,032,946 A 3/2000 Marshall et al.
6,095,316 A 8/2000 Redden
6,135,697 A 10/2000 Isaacs et al.
6,142,723 A 11/2000 Kang
6,172,355 B1 1/2001 Gast et al.
6,179,283 B1 1/2001 Gerstenberg et al.
6,183,191 B1 2/2001 Mondie et al.
6,217,020 B1 4/2001 Supron et al.
6,234,737 B1 5/2001 Young et al.
6,238,164 B1 5/2001 Isaacs
6,257,821 B1 7/2001 Ward et al.
6,270,070 B1 8/2001 Salomon et al.
6,276,509 B1 8/2001 Schuster et al.
6,354,587 B1 3/2002 Engarto
6,390,756 B1 5/2002 Isaacs et al.
6,431,369 B1 8/2002 Boller et al.
6,454,253 B1 9/2002 Tranquilla
6,503,044 B1 1/2003 Enenkel
6,511,062 B1 1/2003 Blackwell et al.
6,561,339 B1 5/2003 Olson et al.
6,575,306 B1 6/2003 Schuster et al.
6,585,256 B2 7/2003 Blackwell et al.
6,612,565 B2 9/2003 Blackwell et al.
6,618,645 B2 9/2003 Bacchi et al.
6,619,647 B2 9/2003 Post et al.
6,629,691 B2 10/2003 Niiyama et al.
6,679,491 B2 1/2004 Luebben et al.
6,702,281 B2 3/2004 Post et al.
6,719,519 B2 4/2004 Liehs
2002/0003330 A1 1/2002 Neri et al.
2002/0053768 A1 5/2002 Blackwell et al.
2002/0067981 A1 6/2002 Bonora et al.
2002/0079254 A1 6/2002 Soldavini et al.
2002/0125177 A1 9/2002 Burns et al.
2002/0153654 A1 10/2002 Blackwell et al.
2003/0012637 A1 1/2003 Sperger
2003/0015834 A1 1/2003 Post et al.
2003/0015835 A1 1/2003 Post et al.
2003/0103838 A1 6/2003 Liehs
2003/0141651 A1 7/2003 Berdelle-Hilge et al.
2004/0065596 A1 4/2004 Hanson
2004/0065597 A1 4/2004 Hanson

* cited by examiner

AUTOMATED INDUCTION SYSTEMS AND METHODS FOR MAIL AND/OR OTHER OBJECTS

The present application claims priority to Provisional Application Ser. No. 60/469,828, filed on May 13, 2003, entitled Enhanced Object-Feeder Pre-Processing System and is a continuation-in-part of Non-Provisional application Ser. No. 10/400,522, filed on Mar. 28, 2003, entitled Stack Correction System And Method, the disclosures of which are both incorporated herein by reference in their entireties.

BACKGROUND

1. Field of the Invention

The present invention relates generally to, among other things, systems for handling mail (including, e.g., flats, envelopes, letters, postcards and/or other mail) and/or other objects, and certain preferred embodiments relate, more particularly, to automated systems for pre-processing mail flats handled by mail flats sorting systems.

2. Background Discussion

The following discussion is based on the inventors' knowledge and should not be construed as admissions of knowledge in the prior art.

Currently, a variety of systems are used for the handling of objects, such as, e.g., thin objects like mail flats and/or other mail. For example, the United States Postal Service (USPS) uses various systems to facilitate and enhance the handling of mail flats. Some illustrative mail processing systems are described in U.S. Pat. No. 6,443,311 (the '311 patent), assigned to Northrop Grumman Corporation, entitled Flats Bundle Collator, the disclosure of which is incorporated herein by reference in its entirety as though recited herein in full.

As another example, one illustrative mail processing system is the AFSM100™ flats sorting system built by Northrop Grumman Corporation and Rapistan Systems and used by the USPS The AFSM100 flats sorting machine is a mail sorting system that can process, e.g., large pieces of flat mail, such as for example magazines, in large volumes. Each AFSM100 system has three mail-feeding units.

In some of these existing mail processing systems, feeders are used to deliver mail into the systems for processing. In some illustrative and non-limiting examples, these feeders include a delivery portion and a destacking (e.g., singulating) portion. In such systems, mail is typically placed onto the delivery portion and delivered to the destacking portion. In these example systems, the mail pieces are usually delivered to a sorting section in pieces (e.g., usually having a fixed gap and/or a fixed pitch).

In such systems, operators typically load (such as, e.g., manually from mail storage hampers) the mail to be processed onto the delivery portion at the beginning of the operation. The operators usually continue to load the mail while the system processes the mail.

While the USPS processes approximately 200 billion pieces of mail per year, the mail that is processed requires substantial manual loading and tending by operators. With reference to FIGS. 1(A)–1(B), an operator typically loads mail in existing systems as follows: a) mail is brought toward the feeder in trays, tubs, carts or hampers; b) with reference to arrows A in FIGS. 1(A)–1(B), the operator manually moves handfuls of mail from the tray, tub, etc., and places it onto a surface of the system; c) the operator then integrates a new handful of mail into the stack of mail in process by moving the paddle as depicted by the arrows B shown in FIGS. 1(A)–1(B) such that new mail is captured in the stack of mail in process (the paddle then moves synchronously with a conveyor surface); d) the process is repeated.

This manual process involves a substantial amount of demanding labor and imposes a set of repetitive motions on the operators performing the loading. For letter mail, processing systems may demand about 40,000 pieces an hour. For flats mail, systems may require between about 20,000 and 40,000 pieces per hour distributed over a number of loading consoles (usually, three or four). In such cases, operators may be required to load between about 7,000 and 10,000 flats per hour. With reference to flats, by way of example, these consumption rates can require the operators to lift, transfer and groom approximately 5000 pounds of mail per hour.

In modern-day mail processing environments, sorting and other systems are continuing to run faster and longer than that in the past. The burden placed upon the operators who feed and/or operate the systems, thus, continues to increase. In many instances, the performance of mail processing equipment is increasingly dependent upon an operator's capacity to support the system.

As described above with reference to FIGS. 1(A)–1(B), mail processing delivery systems typically include both a transport system (e.g., a belt or magazine conveyor) and a pusher (e.g., paddle) system that work in tandem to deliver mail to the destacking system. In such systems, the transport system defines the rate at which the mail is delivered to the destacking system. In addition, the pusher system defines the orientation angle at which the mail is presented to the destacking system. In such systems, the transport system and the pusher system move together synchronously and are physically coupled to the same drive chain. In this manner, the pusher system acts as a "bookend" for the stack of mail as the mail is transported via the transport system.

Among other things, the elevated demands placed upon the operators who feed the systems, requires that operators present more mail and/or present mail at a faster rate. This can, e.g., reduce the amount of time available for operators to adjust, groom and/or otherwise manipulate the mail on the delivery system (e.g., to ensure that it is properly oriented for, for instance, efficient destacking).

With existing mail feeding systems that have a transport system and a pusher system that are tied together through a single drive mechanism, the synchronous nature of these systems inhibits them from being able to automatically compensate for poorly stacked mail (e.g., leaning too far forward [such as, e.g., in a manner similar to that denoted by dashed lines B shown in FIG. 2(A)] and/or too far backward [such as, e.g., in a manner similar to that denoted by dashed lines A shown in FIG. 2(A)]). These existing systems rely on the operator to correct stacking problems on the delivery system. FIG. 2(A) illustrates, among other things, several states of how the mail can be presented to the destacking unit, with an illustrative preferred state shown in solid lines.

The stack of flats depicted in solid lines in FIG. 2(A) depicts one optimal condition for presenting the flats (e.g., mail) to a destacking system in preferred embodiments. With systems as described above, an operator typically needs to repeatedly groom (e.g., manually handle and/or manipulate) the mail as it is fed into the destacking section. Otherwise, the angle of orientation relative to the paddle may vary too substantially. As a result, the variation in orientation angle will likely cause a decrease in throughput, an increase in multi-feeds, an increase in damage and/or other problems.

Therefore, a need exists for a systems and methods that can overcome, among other things, the above and/or other problems with existing systems.

SUMMARY OF THE INVENTION

Various embodiments of the present invention can significantly improve upon existing systems and methods. In some preferred embodiments of the present invention, one or more of the above and/or other problems with existing systems can be overcome.

The preferred embodiments enable the automatic loading of prepared mail in carriers onto mail processing systems. The process of automatic loading can reduce the requirements on operators—such as, e.g., enabling one operator to tend multiple feeders or systems. The accuracy, repeatability and/or delivery speed of the preferred embodiments can support higher throughput than was available with prior systems. In preferred embodiments, the system can still be run manually and can still retain full functionality for operators to even manually move a paddle during the process. In various embodiments, a variety of configurations and indexing means can be used to provide the desired paddle movements, such as, e.g., ball screws, slide mechanisms, belt drives and/or any other appropriate drive mechanisms.

In some embodiments, the automatic loading features can be integrated into a substantially fully automated operation in which carriers of mail are delivered to the system by material handling equipment such as conveyors, transfer mechanisms, elevators and/or other means. The system can be configured to accept carriers from any direction to accommodate various machine layouts and facility constraints.

According to some embodiments, a system for automated loading of a side-by-side stack of thin objects to a thin-object feeder can include: a) a transporter having a transport surface upon which a side-by-side stack of thin objects can be conveyed; b) a carrier, configured to carry a side-by-side stack of thin objects, supported above the transport surface; c) a pusher supported above the transport surface; d) the pusher and the carrier being movable relative to one another between a first position in which the pusher is inside the carrier behind a side-by-side stack of thin objects on the carrier and a second position in which the pusher is laterally displaced from the carrier, such that the side-by-side stack of thin objects on the carrier is laterally slidable off of the carrier by the pusher. In some embodiments, the system further includes independent drive mechanisms for the pusher and the carrier, wherein the carrier is driven in a fore-and-aft direction via a carrier support, and wherein the drive mechanism for the pusher includes a fore-and-aft drive component and an up-and-down drive component, and the pusher is movable into the carrier to engage thin objects therein.

According to other embodiments, a method of automated loading of mail to maintain a side-by-side stack of mail on a mail feeder, comprises: conveying a carrier filled with a side-by-side stack of mail to a location above the feeder; laterally moving the side-by-side stack of mail and the carrier relative to one another such that the side-by-side stack of mail on the carrier is laterally slid off of the carrier and onto a transport surface of the mail feeder to a side-by-side stack of mail on the feeder. In some embodiments, the method further includes laterally moving the side-by-side stack of mail with a pusher towards a mail stack processing location of the mail feeder. In some embodiments, the method further includes conveying another carrier filled with a side-by-side stack of mail to a position adjacent the side-by-side stack of mail at the mail stack processing location. In some embodiments, the method further includes raising the pusher and then moving the pusher to a position within the another carrier adjacent the side-by-side stack of mail in the another carrier.

According to other embodiments, a method for upgrading a mail system having a transporter upon which mail is supported for movement and a pusher against which mail is supported during movement, wherein the pusher and the transporter are originally connected to move synchronously via the same drive mechanism, can include: a) providing a carrier support adapted to move above the transporter; b) replacing the single drive mechanism with independent drive mechanisms for the transporter and the pusher, wherein the drive mechanism for the pusher includes a fore-and-aft drive component and an up-and-down drive component, and the pusher is movable to within a carrier upon the carrier support.

According to other embodiments, a method for processing mail delivered to at least one mail feeder having a conveyor from which mail is fed to a downstream system, can include: a) delivering mail on a carrier via a delivery system; b) automatically delivering the carrier via the delivery system to the feeder without requiring an operator to handle the carrier; and c) automatically transferring mail from the carrier to the conveyor of the feeder. In some embodiments, the method further includes delivering carriers from a plurality of preparation operator locations to a common supply, and delivering the carriers from the common supply to a plurality of feed operator locations proximate respective mail feeders. In some embodiments, the method further includes automatically returning the carrier from the feeder via a return conveyor.

The above and/or other aspects, features and/or advantages of various embodiments will be further appreciated in view of the following description in conjunction with the accompanying figures. Various embodiments can include and/or exclude different aspects, features and/or advantages. In addition, various embodiments can combine one or more aspect or feature from other embodiments. The descriptions of aspects, features and/or advantages of particular embodiments should not be construed as limiting other embodiments or the claims.

BRIEF DESCRIPTION OF THE DRAWINGS

The accompanying figures are provided by way of example, without limiting the broad scope of the invention or various other embodiments, wherein.

DETAILED DESCRIPTION OF THE PREFERRED EMBODIMENTS

Figures 1A, 1B:
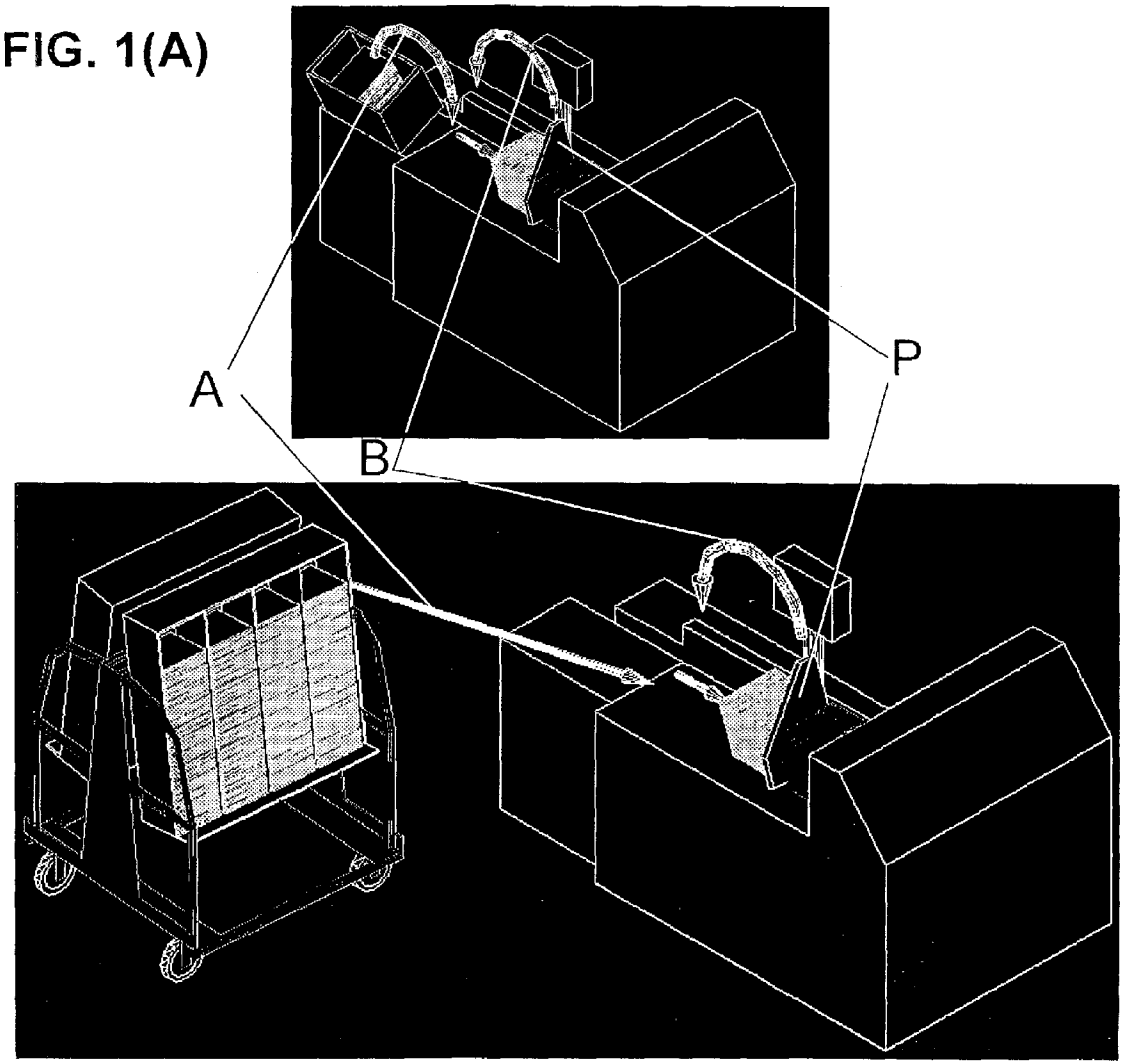
FIG. 1(A) is a schematic diagram illustrating existing manual loading processes for mail feeding systems.
FIG. 1(B) is another schematic diagram illustrating existing manual loading processes for mail feeding systems.

While the present invention may be embodied in many different forms, a number of illustrative embodiments are described herein with the understanding that the present disclosure is to be considered as providing examples of various principles of the invention and such examples are not intended to limit the invention to preferred embodiments described herein and/or illustrated herein.

The preferred embodiments can provide, among other things, a substantially or entirely automated system for use in the processing of thin objects (including, e.g., three-dimensional objects having a size in first dimension that is substantially smaller than sizes in second and third dimensions). While the preferred embodiments can be used to process mail (including, for example, flats, envelopes, letters, postcards and/or other mail), and the most preferred embodiments can be used to process mail flats, various embodiments can also or can alternatively be used to process other thin objects, such as, e.g., sheets, boards, panels, planar materials, paper goods and/or other thin objects.

Various embodiments of the present invention can be employed in a variety of systems and devices. In some non-limiting examples, embodiments of the present invention can be employed within systems similar to that shown in U.S. Pat. No. 6,443,311 (the '311 patent), assigned to Northrop Grumman Corporation, entitled Flats Bundle Collator, the disclosure of which is incorporated herein by reference in its entirety as though recited herein in full, such as, e.g., to upgrade the feeder 10 shown in FIG. 1 of the '311 patent.

Additionally, various embodiments of the present invention can be employed, in other non-limiting examples, within an AFSM100™ flats sorting machine built by Northrop Grumman Corporation and Rapistan Systems and used by the United States Postal Service (USPS). The AFSM100 flats sorting machine is a mail sorting system that can process, e.g., large pieces of flat mail, such as for example magazines, in large volumes. Each AFSM100 system has three mail-feeding units and embodiments of the present invention can be utilized to improve one or more, preferably all, of these mail-feeding units. In some preferred embodiments, an AFSM100 system is adapted to employ automatic flats stack correction by, e.g., splitting a mail delivery system into two separately controlled components such that, e.g., the machine can deliver mail more efficiently to a sorting unit. Preferably, this is accomplished substantially independently of an operator.

While some embodiments can be used, e.g., with feeders that feed mail, such as that of the AFSM100 system, various other embodiments can be used with feeders that feed other objects or materials. The terminology feeder includes, as per Webster's II New Riverside Dictionary, "[a] device that supplies . . . material" and is not limited to any particular form of feeding or to any particular object fed.

In some embodiments, a delivery system that delivers carriers to a feeder can include one or more transporter and/or one or more conveyor (such as, e.g., supply conveyor 110 described below). The terminology delivery system includes any system that delivers objects and encompasses one or more, e.g., transporter(s), conveyor(s) and/or the like.

Figure 2A:
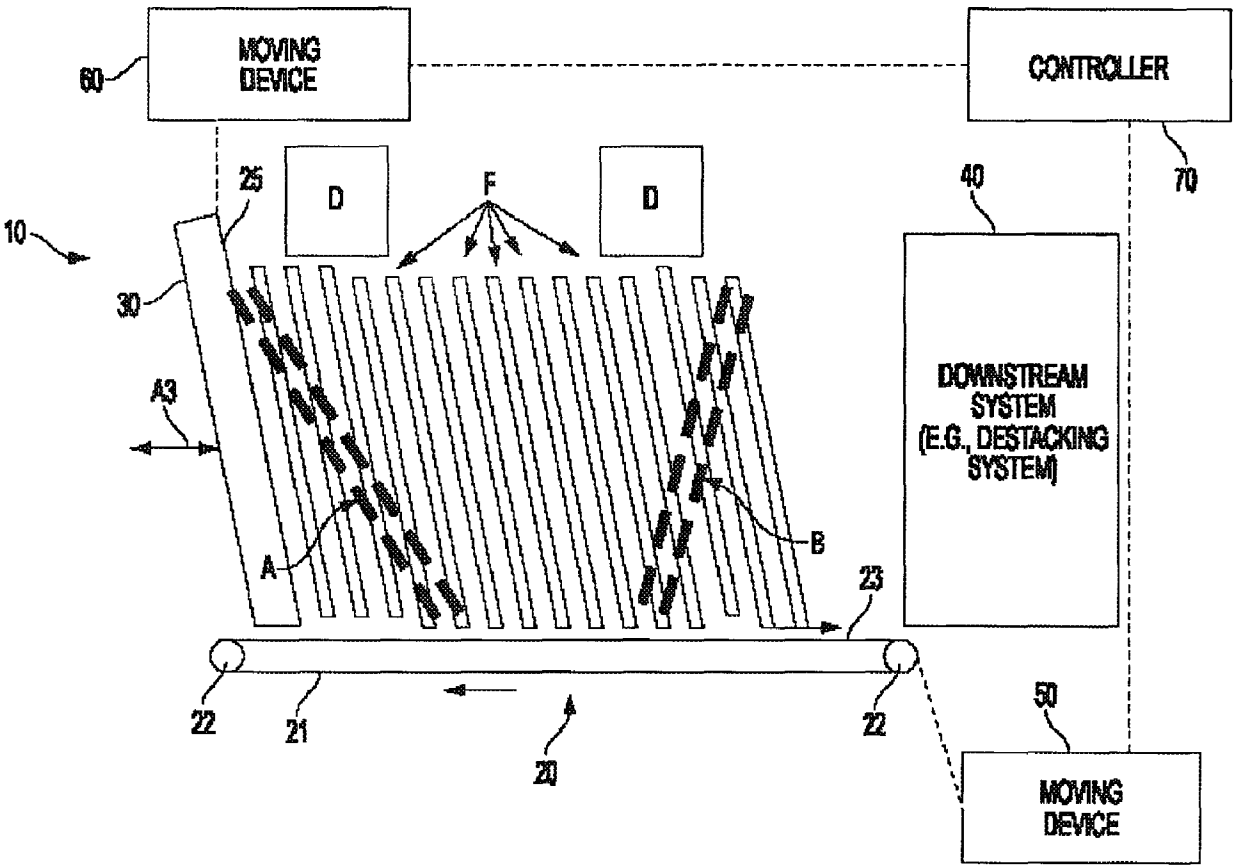
FIG. 2(A) is a schematic side view of a system according to some embodiments of the invention.

FIG. 2(A) shows an illustrative stack induction and correction apparatus 10 that can be employed in some preferred embodiments of the invention. In these preferred embodiments, the stack induction and correction device includes a transporter 20 and a pusher 30 as shown in FIG. 2(A). As described below, the stack induction and correction device can preferably a) automatically induct mail to create a mail stack and b) automatically correct the stack during operation. With respect to this stack correction, a system's performance can be enhanced or degraded by the "quality" of a stack as it is presented to a downstream system, such as a destacking system. For example, mail that is either too loose or that is too tight can cause problems, such as for example, system jams, multi-feeds (where, e.g., more than one piece is inducted into the system), system and/or mail damage, adverse effects on the system throughput and/or other problems. In many cases, the orientation angle of the mail (e.g., relative to the face of the pusher) can significantly affect the system. For example, if the mail is slumped (such as, e.g., in a manner similar to that denoted by dashed lines A shown in FIG. 2(A)) the system's performance can substantially degrade. In some instances, it can be helpful to present the mail to the destacking system such that it is generally uniformly aligned with an angle of the pusher system (such as, e.g., in a manner similar to that shown in FIG. 2(A)).

Pusher

While in some illustrative embodiments, the pusher includes a paddle as shown in FIG. 1, the pusher can have a variety of configurations and can, for example, be made with at least one block-shaped member, at least one wedge-shaped member, a plurality of sub-members (such as, e.g., cross-bars, fingers, tines, etc.), at least one blade member and/or any other appropriate structure capable of defining an object holding surface 25. In some preferred embodiments, the object holding surface 25 can have a single contact section, while in other preferred embodiments it can have a plurality of contact sections. In some preferred embodiments, the object holding surface 25 can be generally planar, while in other preferred embodiments it can be substantially non-planar. It should also be noted that the pusher itself need not be tilted so long as it is configured to define a mail holding surface 25 having an appropriate orientation. In some preferred embodiments, the surface 25 is oriented at a non-perpendicular angle relative to a transport surface 23 of the transporter 20. In various embodiments, any appropriate angular orientation can be selected based on circumstances and may involve an recline, no angle, a forward tilt or any other angle.

In some embodiments, the pusher is adapted to move fore-and-aft in the direction of the arrows A3, while retaining a substantially non-perpendicular or reclined orientation as shown in FIG. 2(A). In some preferred embodiments, the angle of recline can vary from about 10° from perpendicular to about 20° from perpendicular; however, the angle of recline can vary from 0° (i.e., perpendicular) to over 20° based on circumstances.

In some embodiments, the pusher can be mounted such that, when desired, it can be raised upward and moved back to a left side of the transporter 20 to support additional mail or the like.

Transporter

With respect to the transporter 20, various embodiments of the invention can employ any appropriate structure that is known or available. The terminology transporter includes any device that transports or conveys from one place to another. In some embodiments, the transporter 20 can include a conveyor, a sliding plate, a laterally moved support, a trolley, a plurality of rollers, an inclined plate (such as, e.g., an inclined plate having a low friction surface along which objects can slide due to gravitational or other forces) and/or any other appropriate transporter mechanism known or available having, e.g., a transport surface 23 with which objects may be transported. In that regard, the transport surface 23 can include, e.g., one or more conveyor belt surface(s), one or more sliding plate surface(s), one or more laterally moved support surface(s), one or more trolley surface(s), one or more roller surface(s), one or more inclined plate surface(s) and/or other appropriate surfaces. In some preferred embodiments, the surface 23 can include a single section (such as, e.g., an outer surface of a single conveyor belt as shown), while in other preferred embodiments it can have a plurality of sections (such as, e.g., outer surfaces of a plurality of separate conveyors, rollers or the like). In some preferred embodiments, the surface 23 can be generally planar and generally horizontal (see, e.g., FIG. 2(A)), while in other preferred embodiments it can be substantially non-planar and/or substantially non-horizontal.

In the embodiment shown in FIG. 2(A), the transporter 20 can be configured to transport mail, such as, e.g., flats F towards a downstream system 40. The system 40 can include any appropriate system, and, in some preferred embodiments, the system 40 is a destacking system. A destacking system can, e.g., singulate and/or feed flats to other systems or devices. In some preferred embodiments, the transporter 20 can include a conveyor belt 21 that is rotatably supported on rollers or pulleys 22 in a continuous manner to define an upper run or surface 23 upon which a stack of mail can be placed. The mail transport surface 23 is preferably parallel to a direction of travel of the pusher 30 as indicated by arrows A3 but may be otherwise oriented (such as, e.g., at a slight angle) relative to the direction of pusher travel based on circumstances.

As shown in FIG. 2(A), a moving device 50 (such as, e.g., a motor and/or another mechanism for effecting movement of the transporter 20) is preferably included. In one illustrative example, the moving device 50 can include a motor that is connected so as to rotate the pulley(s) 22. In addition, a second moving device 60 (e.g., at least one motor and/or another mechanism for effecting movement of the pusher) is also preferably included. The pusher can be, for example, supported on a support block that is mounted so as to laterally move along a generally horizontal track (such as, e.g., via roller bearings or the like) and so as to upwardly move along a generally vertical track (see, e.g., embodiments described below). In some embodiments, track(s) and/or a support block can be located adjacent the transporter surface and behind a retaining wall 30R that helps maintain flats upon the transporter (such as, e.g., shown in FIG. 2(B)). In other embodiments, various other mechanisms can be used to move the pusher fore-and-aft and/or up-and-down to follows a desired path, such as screw shafts, hydraulic cylinders, robotic mechanisms, reciprocating arms, mechanical linkages and/or various other mechanisms.

Non-Synchronous

In preferred embodiments, the pusher and transporter systems are adapted to be capable of moving non-synchronously and/or independently from one another in a manner to correct for poor stack angle and to allow the pusher to be independently directed to assist in the automatic loading of mail or the like from carriers. In preferred embodiments, the moving devices 50 and 60 include independent devices, such as, e.g., independent servomotors. As discussed above, a variety of mechanisms can be used to effect movement of the transporter and the pusher.

In the embodiment shown in FIG. 2(A), the moving devices 50 and 60 are both operated via a common controller 70. The controller can include, for example, an electronic control means, such as a computer (e.g., a personal computer [PC], a network computer, a server and/or any other computer device, such as any device that accepts information [e.g., in the form of, e.g., digital data] and processes it based on programming or a sequence of instructions), a processor (e.g., a microprocessor), an integrated circuit, or the like. In some embodiments, separate controllers can be employed to operate each respective moving device 50 and 60 and/or components thereof. In some embodiments, the controller 70 can include a plurality of controllers.

In some embodiments, the controller 70 can include software to control separated pusher and transporter mechanisms using, for example, programmable logic controllers (PLCs), one or more external personal computer (PC) or the like, one or more programmable servo drive and/or other devices. In addition, in preferred embodiments, control is carried out based on input from one or more sensor device(s) D. The sensor device(s) D can be used to sense, detect, estimate and/or otherwise evaluate the condition of the flats (such as, e.g., flat orientation). In some embodiments, the sensor device(s) D can sense flat orientation at a plurality of positions along the transporter 20, or along substantially the entire length of the transporter 20, or along the entire length of the transporter 20. In the illustrated embodiment, two sensor devices D are depicted. However, any appropriate number of sensor device(s) D can be selected depending on circumstances. In some embodiments, the sensor device(s) D can include one or more photo-light beam sensor, one or more photo-light sensor array, one or more pressure sensor, one or more camera and/or one or more appropriate sensor device to, e.g., detect when the flats (e.g., mail flats) are not being presented or delivered properly (e.g., to a sorting unit or the like).

When certain conditions are detected by these sensors, separate drive systems on the delivery system can be adapted to correct for, e.g., poorly loaded mail. For example, the moving devices 50 and 60 can be adapted to alter respective speeds, accelerations, relative positions and/or the like. In this manner, an improved efficiency can be achieved. This can also enable a higher throughput, a reduction in damage to mail, such as, e.g., flats and/or to the system, a reduction in the amount of multi-fed pieces of mail and/or various other advantages.

Figure 10A:
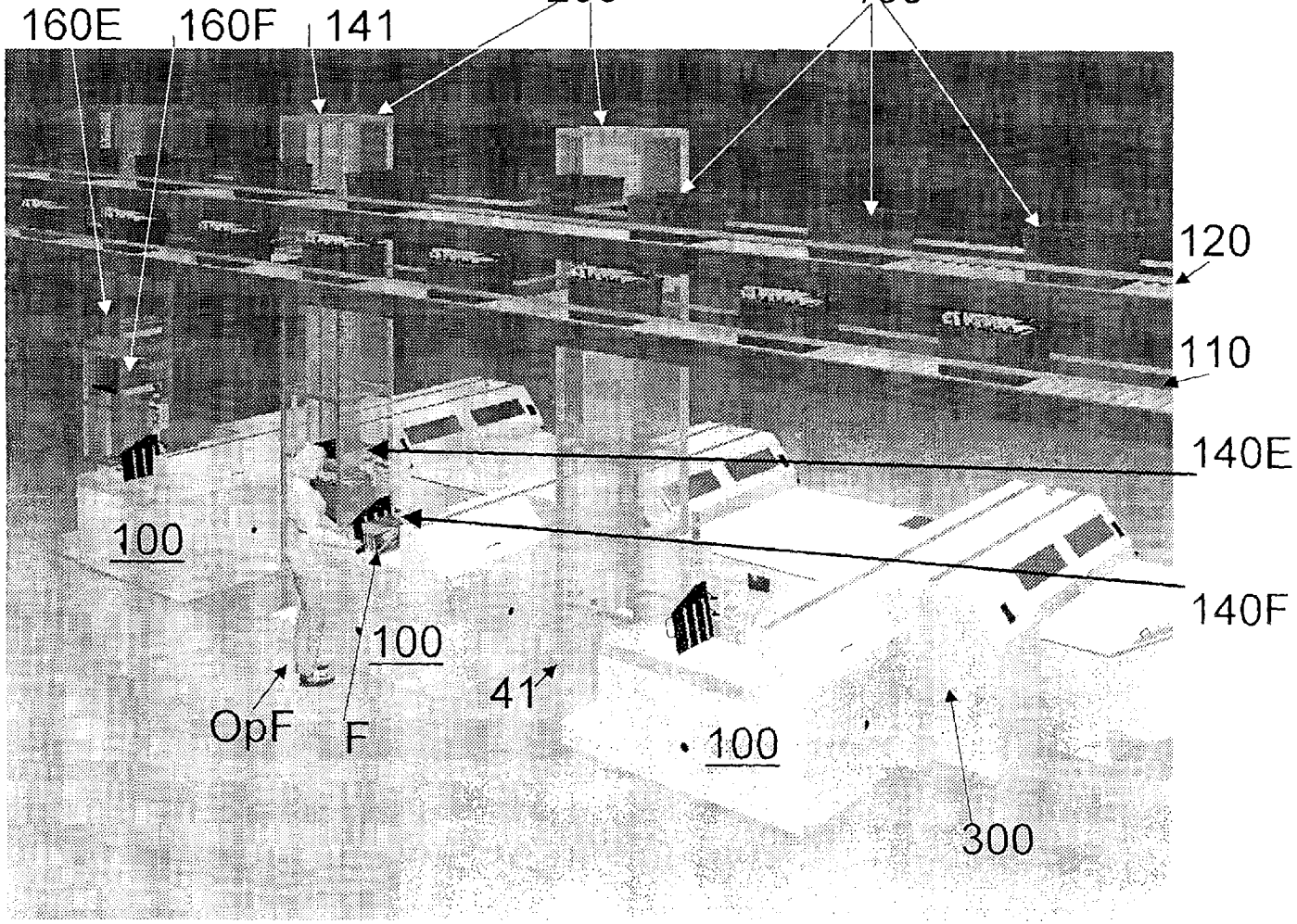
FIG. 10(A) is an elevational view of a system wherein carriers are moved generally vertically to-and/or-from a feeder or other system.
Figure 10B:
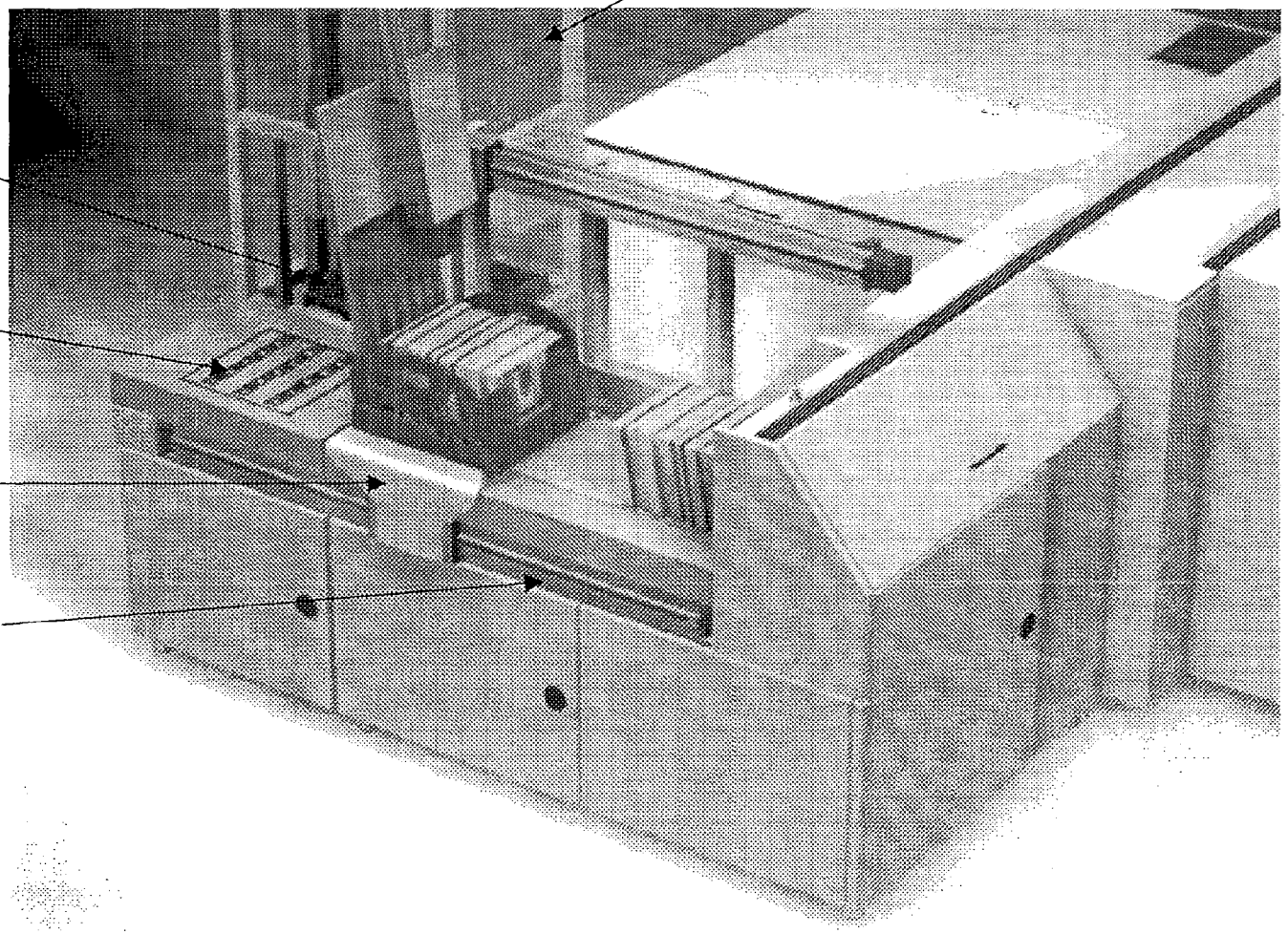
FIG. 10(B) is a perspective view of a mail automatic induction system according to some other preferred embodiments of the invention.
Figure 10:
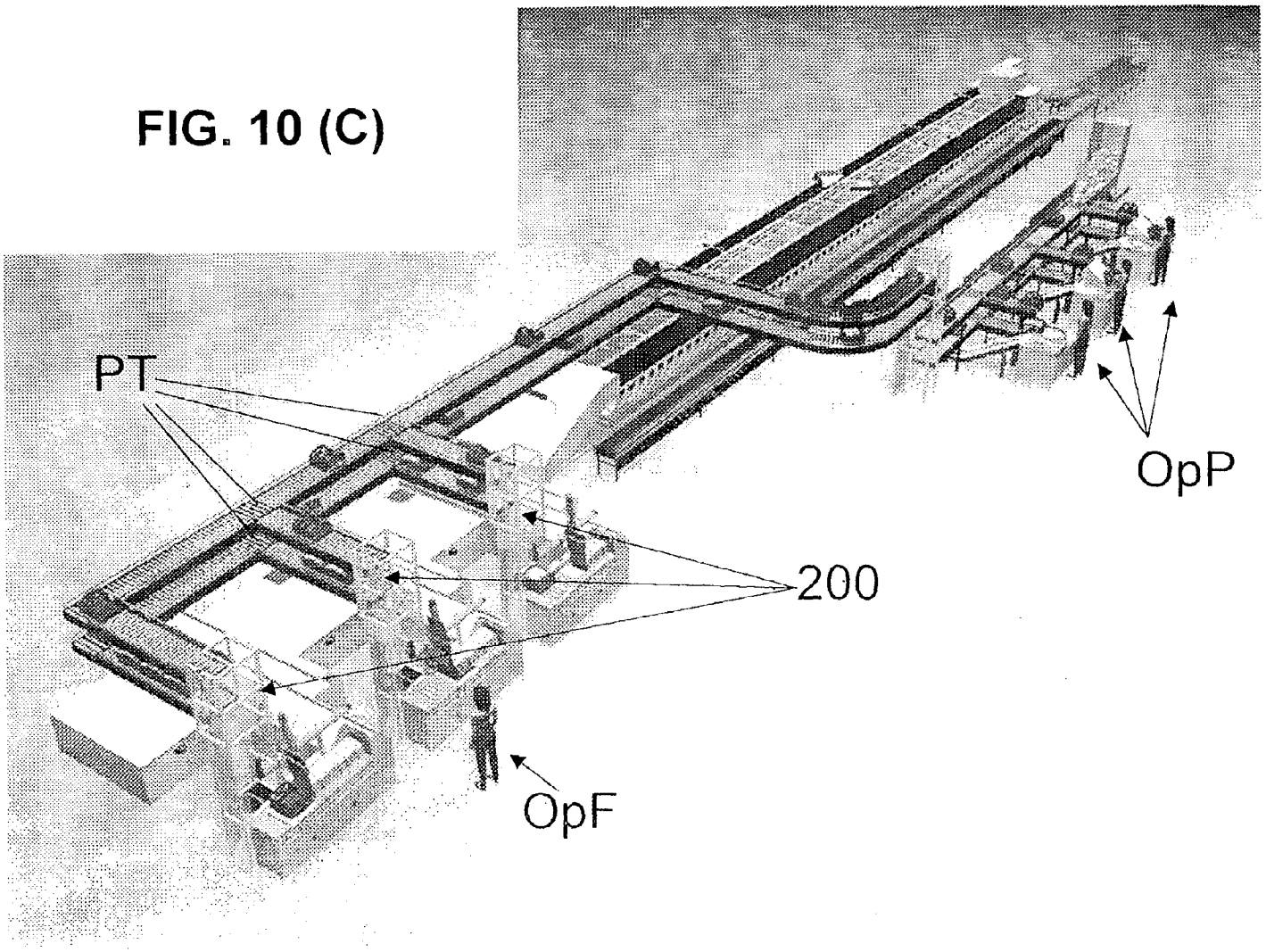
FIG. 10(C) shows one illustrative and non-limiting mail processing system in which embodiments of the present invention can be implemented.

In some embodiments, an operator (such as, e.g., an operator OpF shown in FIGS. 10(A) and 10©)) can affect or can partly control corrections (such as, e.g., via operator interfaces and/or by manually moving the pusher, etc.), such as by receiving operator input to control the manner of correction, to control the extent of correction, to override operation and/or the like. However, substantial advantages can be obtained, in some preferred embodiments, by substantially or entirely eliminating the dependency of a machine's performance on an operator's ability to groom the mail while the system is loaded. In some preferred embodiments, a substantially automatic or entirely automatic stack correction is provided, as well as a substantially automatic or entirely automatic induction of mail or the like (discussed below).

In some preferred embodiments, a "decoupled" delivery system can thus be provided in which a pusher (e.g., a paddle) and a transporter (e.g., a transport system) can be moved independently to, e.g., correct against stacking errors and to effect automatic induction of mail. With respect to stacking errors, in some illustrative cases, stacking errors can include one or more of the following: a) excessive forward lean of one or more flat (such as, e.g., illustratively depicted in dashed lines at B in FIG. 2(A)); b) excessive rearward lean of one or more flat (such as, e.g., illustratively depicted in dashed lines at A in FIG. 2(A)); c) excessive spacing between flats; d) excessive movement of flats independent of transporter movement (such as, e.g., shifting or the like); e) variation in flat height (such as, e.g., variation of height between adjacent flats and/or variation of height of a specific flat); f) variation in pressure (such as, e.g., lateral pressure upon a pusher and/or upon a system downstream of the pusher, such as a destacking unit); g) slippage or movement of flats during transport; and/or h) other conditions as would be now or later apparent to those in the art based on this disclosure. These and/or other error conditions can be sensed by a number of different methods including, e.g., that described above, such as, e.g., pressure sensors (which can be used, e.g., to sense lateral stack pressure at a destacker system and/or at a pusher system), cameras and/or photo arrays (which can be used, e.g., to sense the stack angle or the like), electromagnet wave or light beam sensors (which can include, e.g., sensing via through beams, reflective beams and/or a combination of thereof for detecting stack angle or the like). As discussed above, the system can further include PLCs, external PCs, programmable servo drives and/or other devices that can be used to control and adjust a stack of flats (e.g., mail flats) on the transporter.

Among other things, as discussed above, decoupling the transporter and pusher components and placing them on separate drive systems can enable movement the pusher system independently of the transporter system and vice versa. In some embodiments, if the system sensors detect that the mail is stacked too loosely (e.g., leaning away from the destacking surface), the pusher can be actuated to "tighten" the stack by moving toward the destacking system at a greater velocity than the transporter. In some embodiments, if the system sensors detect that the stack is "over tilted" (e.g., leaning towards the destacking system), the transporter can also be moved forward at a greater rate than the pusher. For example, when a stack of mail has been poorly loaded, since the pusher system is uncoupled from the transporter system, a sensing mechanism (e.g., located, for instance, at or proximate a downstream end of the transporter [e.g., at a destacking system]) can send a signal causing, e.g., the pusher to move forward until a good mail stack condition is achieved (e.g., is sensed).

Preferably, the transporter and the pusher can continue to move at a generally consistent velocity (such as, e.g., at a "normal" velocity corresponding to a particular apparatus "feed" rate) and the relative velocity there-between can be increased and/or decreased during such movement (e.g., via respective corrections). In this manner, the preferred embodiments should be able to increase throughput of the system and avoid errors that may decrease throughput. In less preferred embodiments, stack correction can include stopping the transport system as the pusher is moved forward and/or stopping the pusher as the transport system is moved forward. While these latter embodiments may be readily programmed and implemented, in some circumstances, these can be less preferable because, e.g., there may be a slight decrease in throughput of the system due to stoppage of respective devices.

Figure 2B:
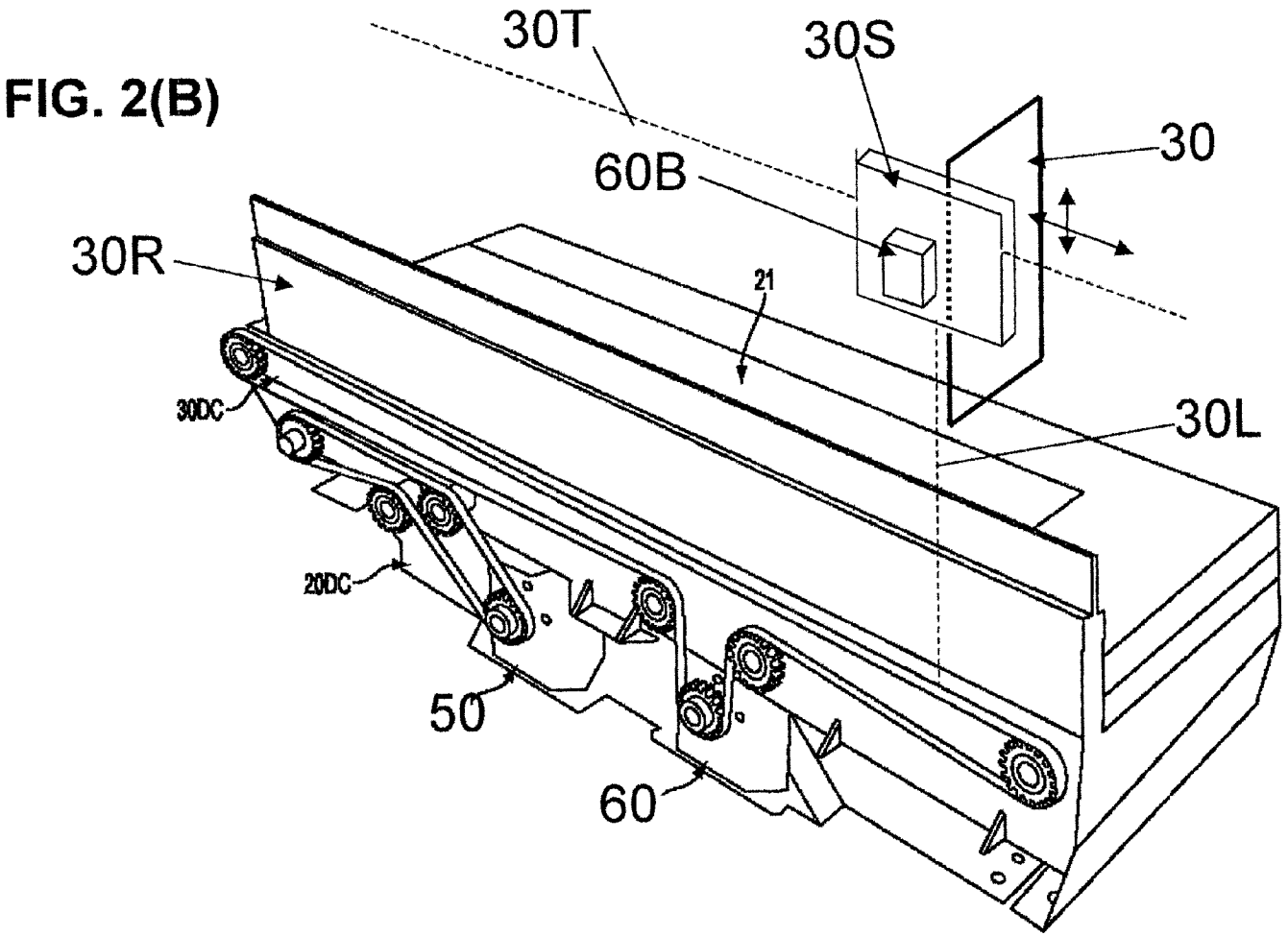
FIG. 2(B) is a rear-side elevational view of portions of some preferred embodiments of the invention demonstrating independent drive mechanisms.

FIG. 2(B) illustrates some components of an automatic stack induction and correction system in some illustrative embodiments of the invention. In these illustrative embodiments, portions of the apparatus (e.g., enclosure walls and the like) are omitted to reveal internal structure. These illustrative, and non-limiting, embodiments can include: asynchronously geared motors 60 and 50 with separate drive chains 30DC and 20DC, respectively, that drive the pusher and transporter systems independently; photo-light sensors (not shown) that signal when conditions exist for the systems to correct the stack angle; and a stand-alone computer (not shown) with software that controls the two independent systems.

As depicted in FIG. 2(B), in some preferred embodiments, the moving device 60 can include a motor 60 that drives a drive chain 30DC or the like to effect fore-and-aft movement of a block 30S (e.g., via a link or the like 30L), the block preferably being mounted for reciprocating movement along a generally horizontal track 30T (shown in dashed lines), and an elevating mechanism (such as, e.g., a second motor 60B and a generally vertical track [not shown] guiding the pusher 30 upon the support block 30S) to effect generally up-and-down movement of the pusher 30 with respect to, e.g., the support block 30S, which together effect desired movement of the pusher.

Method of Upgrading

According to some preferred embodiments, a method of upgrading an existing system (such as, e.g., an existing AFSM100 system) having synchronously coupled transporter and a pusher mechanisms can include modifying the existing system to include independently controlled drives for the transporter and the pusher mechanisms, such as discussed above. In this manner, an advantageous upgrade can be effectively and efficiently implemented. For example, a method of upgrading can include modifying an existing feeder 100 so as to replace the drive mechanisms with features depicted in, e.g., FIG. 2(B). Additionally, the method of upgrading can also include modifying a path followed by a pusher to enable the pusher to be automatically moved to a position to facilitate transfer of objects, such as, e.g., flats out of a carrier (e.g., to laterally slide the flats out of a carrier positioned proximate the feeder as described below).

Implementation In Illustrative Mail Processing Systems

FIG. 10©) shows an illustrative and non-limiting mail processing system in which embodiments of the present invention can be implemented. Embodiments of the invention can be employed in a variety of systems, such as, e.g., within systems disclosed in the above-noted co-pending application 60/469,828 (see, e.g., by way of example FIGS. 9–10, etc.).

In the illustrative system shown in FIG. 10©), one or more preparation operator OpP can fill empty carriers 160 at an upstream loading zone. Among other things, the preparation operator can facilitate efforts of a feed operator OpF by preparing flats for processing. In some embodiments, the preparation operator can, e.g., de-bundle bundled flats fed to the preparation operator along a conveyor (such as, e.g., feeding bundled flats conveyed from a hamper under the lower supply conveyor 110 shown in FIG. 10©)) and can re-orient and place them inside a carrier (e.g., the preparation operator can start with, e.g., bundles laying flat, debundle the same and place the debundled mail in a generally vertical orientation on a carrier).

It is contemplated that in some embodiments, some or all of the preparation operator's manual tasks may be automated. For example, a substantially and/or entirely automatically controlled mechanism could be provided to cut bundles and/or to reorient mail from a horizontal orientation to vertical orientations inside carriers.

Thus, the system preferably eliminates the need for feed operators OpF to 'face' and 'orient' the mail during the loading process into the feeder. In some mail handling systems, orienting and facing is desirable because, e.g., mail-processing equipment typically processes mail in specific orientations (such as, e.g., with bindings down and addresses to the right or bindings forward and addresses to the left, etc.). Among other things, orienting and facing can be desirable due to, e.g., the particular nature of how a particular system transports mail in process and, e.g., the location of any automatic address reading equipment relative to the mail in transport (since, e.g., reading is performed as the mail is moving).

FIG. 10(A) illustrates some aspects and features of mail processing systems in which some preferred embodiments of the invention can be implemented. While FIG. 10(A) does not show a pusher that pushes flats or the like off of carriers, FIG. 10(A) does show various other features, such as, e.g., supply and return conveyor systems, that can be employed in some illustrative embodiments. Various features shown in FIG. 10(A) can be employed in embodiments in which, e.g., a pusher is used to push or slide flats or the like off of carriers (as discussed further below).

In the embodiments shown in FIG. 10(A), a generally vertical elevator 200 is provided. In preferred embodiments, the elevator 200 includes a conveyor system for moving carriers up-and-down between a supply conveyor 110 and a return conveyor 120. In this disclosure, the terminology elevator can include any system or device that can move an object upward and/or downward. Elevators can include a) supports (such as, e.g., platforms or the like that are used to support the object(s) to be moved and/or any other support structure), b) any form of power, such as, e.g., fuel powered motors, electronic motors, hydraulic motors and/or the like and c) any type of drive mechanisms, such as, e.g. extendable cylinders, rotated screw shafts, conveyor belts or chains and/or the like. In some illustrative embodiments, a full carrier supply conveyor 110 can include a powered-roller, zone-accumulation conveyor to queue and transport full carriers from a preparation operator OpP loading zone to a feeder 100 or the like. The conveyor 110 can include, e.g., a plurality of powered rollers 111. In other embodiments, any other conveyor(s) can be employed, such as, e.g., one or more rotary belt(s), one or more pusher(s), one or more moving platform(s) and/or any other appropriate conveyor(s). In preferred embodiments, the return conveyor 120 can be substantially similar to the supply conveyor 110, but usable to return empty carriers. While the conveyors include powered rollers in some illustrative embodiments, one or more other conveyor(s) could be employed in various other embodiments. For example, one or more conveyor belt(s) and/or other conveyor can be included. The terminology "conveyor" used in this application includes any mechanism by which carriers or other items can be moved, such as, e.g., one or more rotary belt(s), one or more pusher(s), one or more moving platform(s) and/or any other appropriate conveyor(s). In preferred embodiments, the conveyors are configured to have differentiated carrier movement between a plurality of zones along the conveyors.

In some preferred embodiments, the elevator conveyor system includes two platforms, including an upper platform 140E for conveying empty carriers 160E and a lower platform 140F for conveying full carriers 160F. In some illustrative embodiments, the platforms 140E and 140F can be mounted together so as to remain a fixed distance from one another (e.g., a distance substantially equal to the distance between the conveyors 110 and 120). In FIG. 10(A), the leftmost elevator shows an empty carrier 160E and a full carrier 160F in transport together. In some instances, however, the platform 140E may be without another carrier during transport of a full carrier 160F to the feeder 100. Then, upon transfer of the objects to the feeder, the emptied carrier can be transferred to the platform 140E. The elevator can then raise the platforms such that the empty carrier 160E is laterally discharged to the conveyor 120, and, such that a full carrier is laterally moved to the platform 140F. Then, the elevator can lower the new full carrier to continue the process. In other embodiments, the platforms 140E and 140F can be controlled so as to move independently from one another. In other embodiments, the platforms could be located adjacent one another (e.g., with a modified elevator 200 having, e.g., plural elevator shafts) so that upward and/or downward movement may occur independently of one another. However, mounting both platforms to move along a path having a common axis can, e.g., enhance space saving characteristics and improve egress around the feeder 100.

In the illustrative embodiment shown in FIG. 10(A), the elevator 200 includes a support frame 141. Preferably, the elevator has transparent and/or translucent walls or windows (such as, e.g., made of glass, plexiglass, plastic or the like) to enable the interior to be viewed during operation. Preferably, the conveyors 110 and 120 include lateral guide rails (as shown), support edges or the like to help retain the carriers thereon. Preferably, carriers 160E and/or 160F are delivered between the conveyors 110 and/or 120 via pop-up lateral transfer mechanisms (such as discussed below with reference to FIG. 10©)). Additionally, in some preferred embodiments, sensors or detectors can be used to facilitate control of the system based on carrier positioning. For instance, the lateral transfer mechanisms can be controlled based on carrier presence within the elevators 200 and the like in some embodiments.

In some illustrative embodiments, the platforms 140E and 140F can include mechanisms to facilitate transfer to and/or from the platform(s). For instance, in some embodiments, the platforms can include powered rollers or powered casters to facilitate movement along one or two axes (e.g., parallel to the platform). In this manner, the carriers can easily be transferred to and/or from the platforms (such as, e.g., at their upper positions proximate the conveyors 110 and 120 and/or at their lower positions proximate the feeder operator OpF). In some preferred embodiments, the front of the elevators 200 in front of the operator OpF will include openings, doors, gates or the like to enable access to the platforms 140E and/or 140F. In some preferred embodiments, fixed and/or pop-up stops can be used to limit movement of the carriers from the elevator until desired.

With reference to the system shown in FIG. 10©), pop-up transfers PT can be used, for example, to transfer carriers to and/or from supply and return conveyors 110 and 120, respectively. FIG. 10©) shows an illustrative system in which full conveyors are conveyed from the preparation operator OpP location(s) via the supply conveyor 110 to the feeders and in which empty carriers are returned to preparation operator OpP location(s). In the embodiment shown in FIG. 10©), the elevators 200 can operate substantially like that described above with reference to FIG. 10(A). In some embodiments, elevators 200 may be located substantially over the feeder console. In other embodiments, elevators 200 may be located adjacent, such as, e.g., directly behind the feeder console as shown in FIGS. 10(B) and 10©). In the latter cases, a mechanism is preferably used to laterally transfer the carriers onto reciprocated carrier supports CS on the feeder console. For example, as shown in FIG. 10(B), the feeder console can include a pop-up transfer conveyor TC that can be moved upward to engage a bottom of the carrier for lateral transfer and that can be lowered to enable reciprocation of the carrier support. In this regard, the carrier support can, e.g., include a generally rectangular frame (such as, e.g., generally similar to a picture frame) with an open interior to allow the transfer conveyor to pop-up there-through to engage the carrier while securely supporting the carrier around the perimeter thereof upon the generally rectangular frame.

Preferred Automatic Induction Embodiments

According to some preferred embodiments, existing equipment can be modified and/or new processing equipment can be developed that provides the capability for that system to automatically load mail or the like from material handling equipment directly onto, e.g., systems (e.g., consoles of feeders) for processing. The preferred embodiments enable the processing equipment (e.g., feeders) to, for example, run more mail, at higher rates, with fewer operators, and without degrading system performance.

According to preferred embodiments, the system(s) can be run with operators functioning in manual-loading modes to, for example, facilitate current operations and/or delivery and/or to facilitate handling mail pieces that cannot be pre-packaged into carriers and/or the like.

FIGS. 3–10 show an illustrative automatic induction system embodiment that includes a retractable paddle and delivery apparatus that can preferably perform some or all of the following tasks: a) automatically present and/or integrate new mail on a carrier to a mail stack being processed; b) automatically remove an empty mail carrier; c) automatically process the mail from the feeder or destacking system while the automatic induction system is in operation (in some cases, however, mail can be pre-loaded at a time when the feeder system is not operated and the mail can simply be loaded onto the console and remain there until the feeder system is started).

Figure 3:
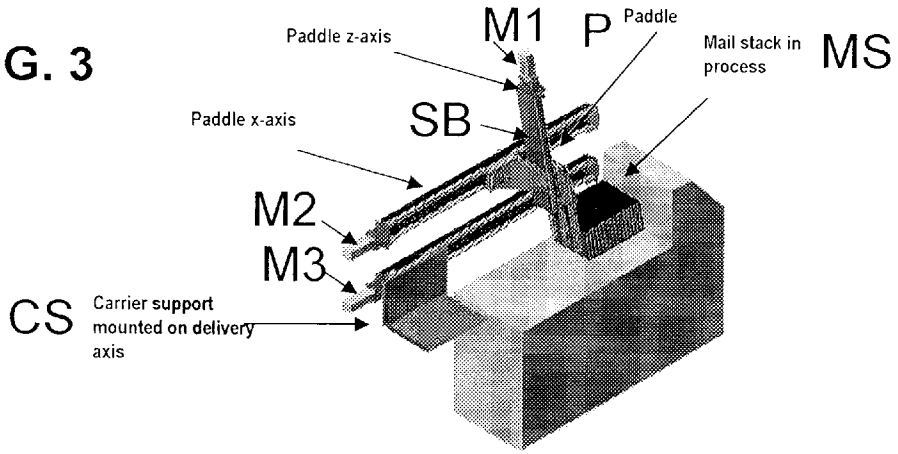
FIG. 3 is a perspective view of a mail automatic induction system according to some preferred embodiments of the invention.

FIG. 3 shows elements of an illustrative automatic feed system implemented in, by way of example, a standard feeder (e.g., a standard flats feeder). As shown, a modified automatic feed pusher, or paddle P, is provided. As shown, the paddle is preferably movably supported upon the support block SB via a generally vertical guide so as to move up-and-down along a z-axis via operation of a motor M1. As shown, the support block SB is preferably movably supported via a generally horizontal guide so as to move fore-and-aft generally along an x-axis via operation of a motor M2. In addition, a carrier support CS is provided that receives carriers C of mail from an outside delivery system and that moves the carriers toward the stack of mail MS for unloading against the stack. As shown, the carrier support CS is similarly supported along a generally horizontal guide for fore-and-aft movement along a delivery axis generally parallel to the x-axis via operation of a motor M3. In preferred embodiments, the motors M1, M2 and M3, the transfer conveyor TC and/or various other elements can be controlled via a controller or the like, such as, e.g., similar to the controller 70 in FIG. 2(A).

In various embodiments, the delivery of the carriers C to the carrier support CS can be effected using a variety of mechanisms, such as, e.g., using: manual delivery, conveyor delivery, elevator delivery, robotic delivery, transfer roller delivery and/or other appropriate mechanisms. In various embodiments, the system can be configured to accept carriers (e.g., to receive carriers upon a carrier support) from any direction (e.g., from a front side, from a back side, from above and/or from below the processing system) to minimize encroachment into the available space around or near the processing system.

FIGS. 4–9 show an illustrative operation of an automatic feed system shown in FIG. 3. In the event that there is no mail on the feeder (such as, e.g., at a start of a run or after the feeder has run dry during processing), the carrier support CS will preferably laterally deliver the mail to adjacent the pickoff of the destacking area (such as, e.g., to accommodate a position similar to that of the mail stack MS in process shown in FIG. 3).

Figure 4:
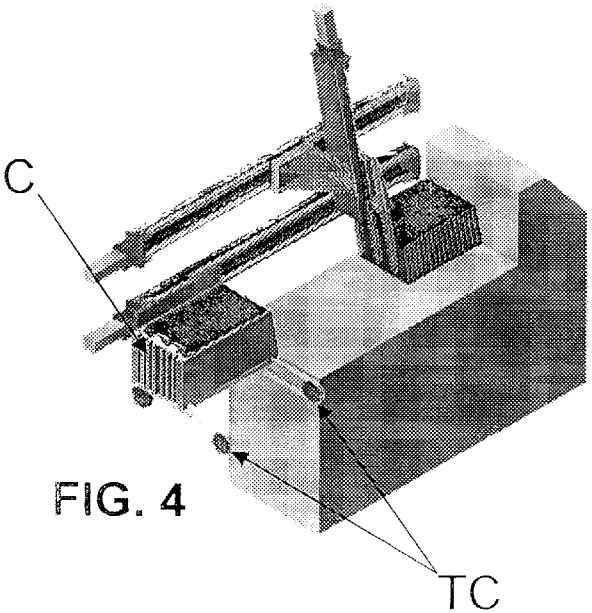
FIGS. 4–9 show an illustrative operation of an automatic feed system shown in FIG. 3.
Figure 5:
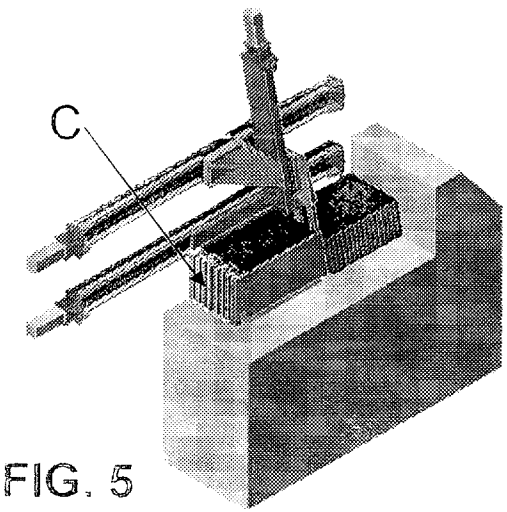
Figure 6:
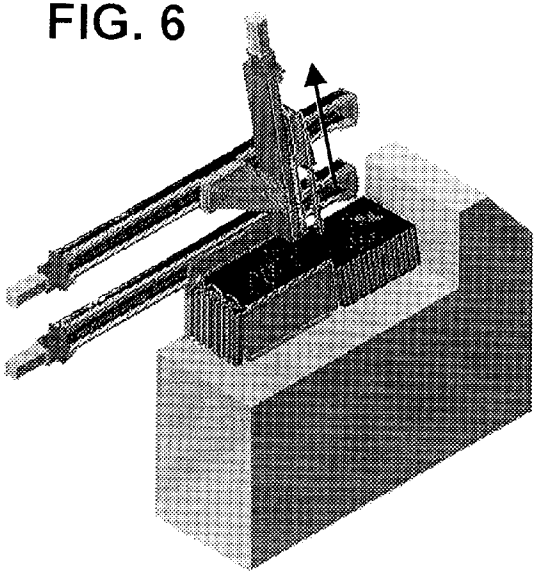
Figure 7:
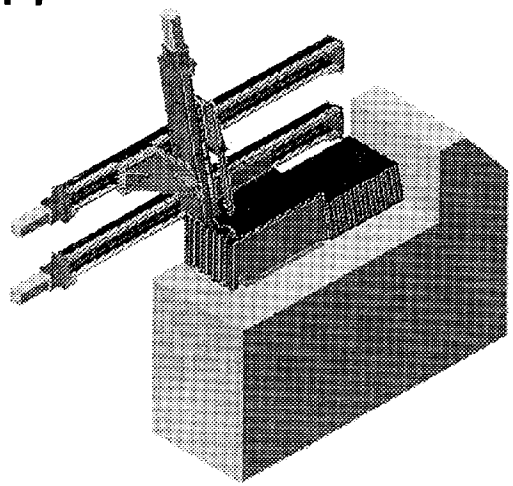
Figure 8:
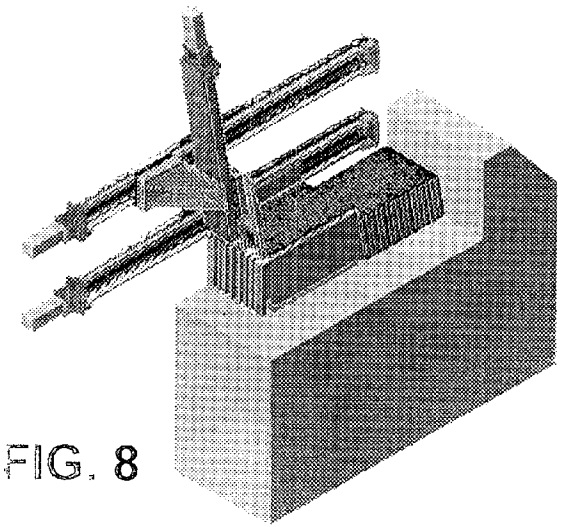
Figure 9:
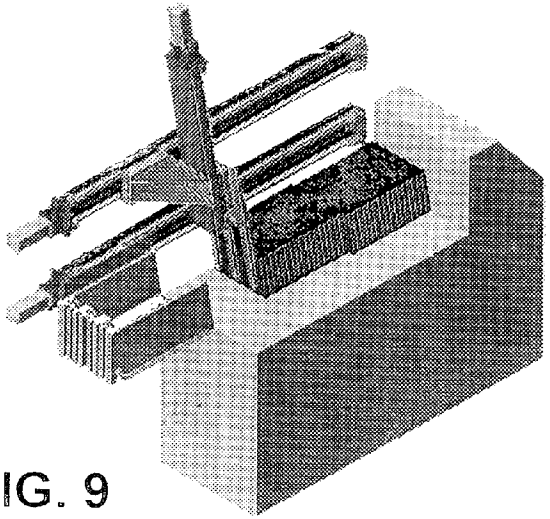

First, as shown in FIG. 4, a full carrier C is positioned on the carrier support CS (shown in FIG. 3 without a carrier loaded thereon). As described below, various carrier designs can be employed. In some preferred embodiments, carriers are configured to enable a) mail to be supported thereon and b) mail to be laterally slid off of the carrier in the direction of the destacking area. In some examples, carrier designs may or may not include covers, one or more side wall(s) and/or one or more movable side support member(s) (e.g., walls, doors, retaining members or the like) to retain the mail in a carrier C until it is unloaded onto the feeder console (e.g., proximate a back of the mail stack in process). Then, as shown in FIG. 5, the full carrier CS is conveyed to a position proximate the back of the mail stack where it is ready to be unloaded. Then, as shown in FIG. 6, the paddle is raised or retracted (i.e., in the direction of the z-axis shown in FIG. 3) from the back of the mail stack MS (i.e., so as to disengage the mail stack). Then, as shown in FIG. 7, the paddle is moved rearwardly (i.e., in the direction of the paddle x-axis shown in FIG. 3) to adjacent the rear of the mail on the carrier. During the time that the paddle moves laterally to the rear of the mail on the carrier, the carrier helps to support and maintain the orientation of the mail stack and the mail can continue to be processed. Then, as shown in FIG. 8, the paddle is lowered into the carrier to a position behind the mail thereon. In this regard, in the illustrated embodiment, the carrier preferably includes a plurality of generally vertical grooves that receive a plurality of depending fingers or tines of the paddle (e.g., providing a generally fork-shape paddle). In this manner, support of the mail can be readily transferred between the carriers and the paddle during operation. Then, as shown in FIG. 9, the carrier is moved rearwardly away from the mail stack by retracting the carrier support in the direction of the delivery axis of the carrier support shown in FIG. 3. At this time, the empty carrier can be removed and a full carrier can be loaded thereon to continue processing. For example, a transfer conveyor TC (such as, e.g., shown in FIG. 4) can laterally transfer the empty carrier C to an elevator for discharge along a return conveyor path. Then, a new full carrier C can be supplied from a supply conveyor path and can be laterally supplied to the support CS via the transfer conveyor TC.

FIG. 10(B) shows one preferred embodiment employing an elevator delivery system (which can, e.g., operate similar to the elevator delivery system shown and described with reference to FIG. 10(A)). In this illustrative embodiment, the elevator delivery system lowers a full carrier to a position proximate a rear side of the feeder. At this position, rollers upon the support 140F can move the carrier C laterally to the carrier support CS. In this embodiment, the carrier support CS is mounted so as to reciprocate along a guide G having a delivery axis in an x-direction similar to that shown in FIG. 3. In addition, as shown, if desired, a lateral conveyor mechanism TC can be integrated in the feeder console to assist in supply of full carriers upon the feeder and/or the return of empty carriers from the feeder.

Carriers

In various embodiments, the carriers 160 can have a variety of constructions (e.g., depending on the characteristics of the objects, such as, e.g., mail, to be carried). In some preferred embodiments, the carriers are made with plastic material. In some preferred embodiments, the carriers are formed by a molding process, such as, e.g., by injection molding. In some preferred embodiments, the carrier size is preferably selected so as to fit a single carrier upon the feeder console.

As described above, in some preferred embodiments, carriers are configured to enable a) mail to be supported thereon and b) mail to laterally slide off of the carrier in the direction of the destacking area. For example, some carrier designs may or may not include covers, one or more side walls and/or one or more movable side support members (e.g., walls, doors, retaining members or the like) to retain the mail in the carrier until it is unloaded onto the feeder console (e.g., proximate a back of the mail stack in process). For example, carriers can have an omitted front wall, such as, e.g., certain carriers described in the above co-pending patent applications or can include a movable front wall. In some embodiments, mail can be automatically and/or manually slid off of the carriers and onto the feeder (preferably, the mail is automatically slid off the carrier as described herein by relative movements of a paddle and a carrier support during processing, while a user can, in some instances, still manually effect such sliding)(although not detailed herein, in some embodiments, a lateral transfer slide, such as, e.g., described in the above co-pending applications can be included and/or the feeder console itself can be inclined to facilitate manual and/or automatic sliding of the mail with respect to the carrier).

While some illustrative carrier designs have been depicted and described, various embodiments can accommodate various carrier designs. For example, various systems according to embodiments of the present invention may operate with a variety of carrier types and designs.

Figure 11A:
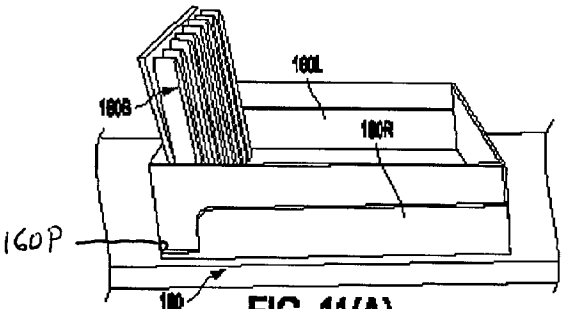
FIGS. 11(A)–11(C) show one embodiment of a carrier having a pivotally mounted front wall.
Figure 11B:
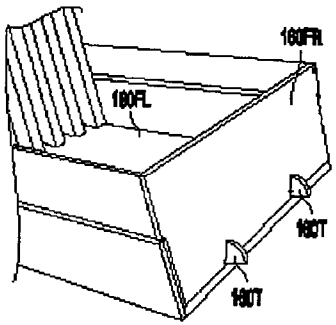
Figure 11C:
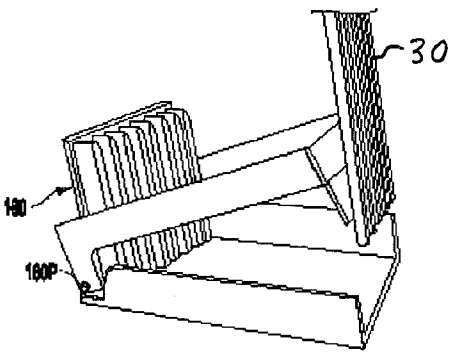
Figure 12:
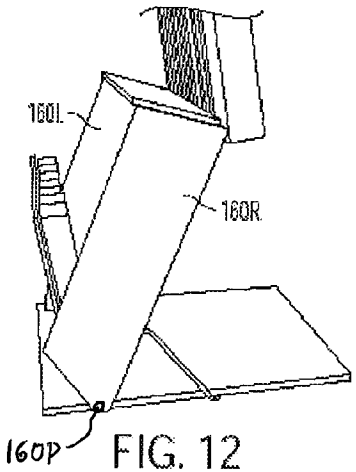
FIG. 12 shows another embodiment of a carrier having a pivotally mounted front wall.
Figure 13:
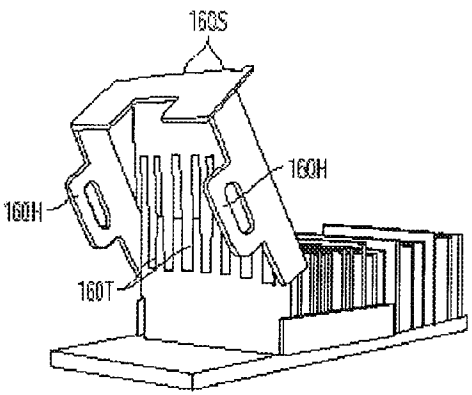
FIG. 13 shows another embodiment of a carrier having a pivotally mounted front wall.

FIGS. 11–13 show some carrier designs according to some illustrative and non-limiting embodiments of the invention. While, in some examples, carriers shown in these figures can be made with either natural or non-synthetic materials (such as, e.g., wood) or synthetic materials, in preferred embodiments, the carriers are made with molded plastics.

In the embodiment shown in FIGS. 11(A)–11©), the carrier 160 includes a floor 160FL, a back wall 160B, a left wall 160L, a right wall 160R and a front wall 160FR. In this embodiment, the front wall 160FR is adapted to provide support of mail or the like contained within the carrier during handling but to be moved out of the way to facilitate removal of mail or the like (such as, e.g., removal by sliding the carrier and the mail relative to one another such that the mail is relatively moved laterally past the front of the carrier). In this illustrative embodiment, the front wall 160FR is supported so as to pivot about left-side and right-side pivots 160P. In this illustrative embodiment, the left and right walls 160L and 160R include upper portions that separate from lower portions as shown in FIG. 11©) when pivoted.

In order to effect pivotal movement of the carrier, a variety of mechanisms can be employed. In some illustrative embodiments, the front wall 160FR of the carrier can be moved via the pusher 30. In this regard, the front wall 160FR and the pusher 30 can be adapted to include engagement members that engage together upon being brought against one another. By way of example, as shown in FIG. 11(B), one or more male protrusion can be supported along the front wall 160FR that engages with one or more respective female receptacle (such as, e.g., formed proximate the lower end of the pusher and sized to engage the male protrusions as shown in FIG. 11©)). In various embodiments, male and female portions can be provided on either the front wall 160FR or the pusher or vise-versa. Additionally, it should be understood based on this disclosure that any other appropriate form of engagement members can be used in various other embodiments.

FIGS. 12 and 13 show other illustrative carrier designs with some modifications from that shown in FIGS. 11(A)–11©). In the embodiment shown in FIG. 12, the entire left and right sides 160L and 160R are pivoted along with the front wall 160FR. In the embodiment shown in FIG. 13, a number of modifications are employed, including: a) a plurality of handles 160H to facilitate manual handling of the carriers (in some embodiments, a latch [not shown] can be included to inhibit the font wall 160FR from pivoting to facilitate carrying—for example, the latch can be configured to release upon contact with the pusher 30); b) a plurality of upwardly extending tines 160T (rather than merely forming grooves in the rear wall); and/or c) a plurality of receptacles or recesses 160S engagable with respective protrusions on the lower end of the pusher 30. In the illustrative embodiments shown in FIGS. 11–13, the pusher 30 includes seven downwardly extending tines that fit between respective grooves and/or tines of the carriers 160. In fork-shape pusher embodiments, any number of tines can be employed, such as, by way of example, between about 3 and 10 tines in some illustrative examples.

The operation of the carriers 160 shown in FIGS. 11–13 can be generally alike in some embodiments, such as for example: a) first, a full carrier (note: objects within the carriers are omitted in the figures) can be in a closed state such as, e.g., shown in FIG. 11(A); b) second, the full carrier can be brought against the lower ends of the tines of the pusher so as to engage with respective engagement mechanisms (e.g. receptacles, protrusions and/or the like); c) third, the pusher can be raised such as, e.g., described above with reference to FIG. 6 (such that as shown, e.g., in FIG. 10©) the front wall 160FR is moved away); d) fourth, the pusher continues to move the wall rearward as it traverses from a position similar to that described above with reference to FIG. 6 to a position similar to that described above with reference to FIG. 7 (see, e.g., FIG. 12 showing an approximately midway position and FIG. 13 showing a substantially fully open position); e) fifth, with the carrier fully open, the pusher descends to engage the rear of the mail, such as, e.g., shown in FIG. 13 (showing the tines in a lowered position); f) sixth, once the tines of the pusher are in a fully lowered position, the carrier can be moved laterally to the left so as to slide the mail off of the carrier; g) seventh, when the carrier and the mail is separated, the carrier is caused to pivot back to a closed position (such as, e.g., using another mechanism to cause the carrier to close [such as, e.g., an abutment mechanism and/or springs {such as, for example, using springs like that shown in FIGS. 12–13}]). Thereafter, the carriers can be returned and/or further handled, such as, e.g., returned to the system in accordance with embodiments described herein.

Other Pusher Embodiments

Figure 14A:
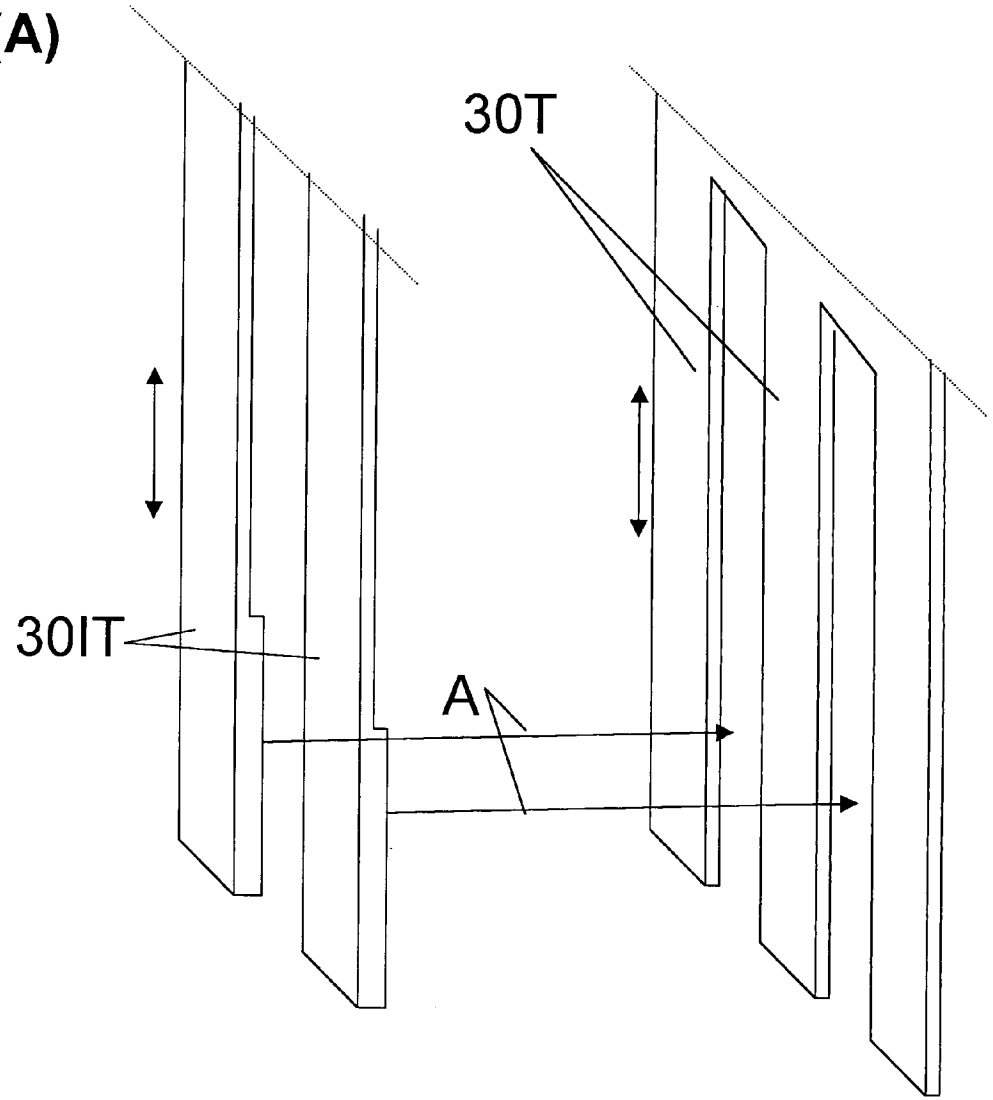
FIG. 14(A) is an exploded view of a pusher according to some embodiments.
Figure 14B:
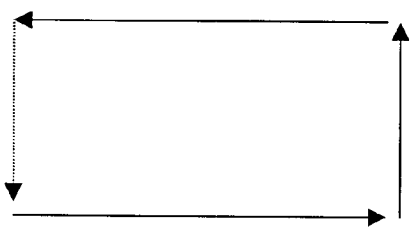
FIG. 14(B) is a schematic flow diagram of a pusher path according to some illustrative embodiments.

FIGS. 14(A)–14(B) show some features that may be employed in embodiments having a pusher as described above.

Control Features:

In some embodiments, control features can be provided that can, e.g., reduce forces applied by a pusher when, e.g., the pusher is lowered into a carrier or the like (see, e.g., shown in FIG. 8). For example, the pusher is preferably controlled so that downward forces during insertion into a carrier are minimized. In this manner, for example, the system can account for, e.g., items that may improperly enter beneath the pusher, whether animate or inanimate items.

FIG. 14(B) shows a schematic diagram of a general path that can be followed by a pusher in some illustrative embodiments. In the illustrated example, the downward arrow (e.g., the downward portion of the movement) is depicted with a dotted line. In some embodiments, at least some of this downward portion of the movement can be effected via a drive mechanism that includes a release mechanism to prevent or inhibit downward movement in the event that the pusher abuts an object (such as, e.g., a user's arm or the like). For example, a clutch mechanism could be employed, a decoupling mechanism could be employed and/or the like. In some embodiments, the drive mechanism does not provide a positive downward drive force, but rather supports the pusher in the downward portion of the path. As a result, the pusher can preferably be released from such support upon impact with an object. By way of example only, a timing belt can be employed that supports the pusher in a manner that the pusher is released upon abutting an item. In some embodiments, a counter-balance can be employed to reduce the downward force of the pusher (e.g, to counter the weight of the pusher). In some embodiments, pressure sensors, detectors and/or the like can be employed to detect inadvertent contact with foreign objects or items, upon which detection a drive mechanism of the pusher can be controlled to automatically stop and/or reverse direction.

Interleaved Tines:

FIG. 14(A) shows an illustrative embodiment employing an interleaved pusher structure that can be used in some embodiments. In this regard, the pusher 30 can include a plurality of downward tines 30T (such as, e.g., three shown in the illustrative and non-limiting embodiment) and a plurality of interleaving tines 30IT (such as, e.g., two shown in the illustrative and non-limiting embodiment). While FIG. 14(A) is an exploded view with the tines 30T and 30IT separated, in use the tines will overlap such that the respective tines are located on a substantially common plane so that the tines 30T and 30IT together form a wider (such as, e.g, a substantial panel-like) structure. As depicted in FIG. 14(A), the times 30T are preferably movable in a generally up-and-down direction (see, e.g., the double-headed arrow adjacent the tines 30T). In addition, as also depicted in FIG. 14(A), the times 30IT are preferably movable in a generally up-and-down direction (see, e.g., the double-headed arrow adjacent the tines 30IT). However, the tines 30IT are preferably movable relative to the tines 30T. During operation, the tines 30IT can be retained in a retracted state during some portions of the path of movement of the pusher and in a lowered state during other portions. For example, during the insertion of the tines 30T into a carrier, the tines 30IT can preferably be in a retracted state.

In some embodiments, the tines 30IT and 30T can both independently include similar control features (e.g., force-inhibiting control features) to that discussed in the preceding section. By way of example, in some embodiments, upon entry of the pusher into a carrier, the retractable tines 30IT can be made to retract due to contact with the carrier (such as, e.g., contact with tines on the carrier).

Multi-Pusher Embodiments

In some preferred embodiments described above, a single pusher 30 can be employed. While there are a variety of benefits with single pusher implementations, in some embodiments, multiple pushers can be employed. In some circumstances, using multiple pushers can facilitate some aspects of handling a mail stack upon a feeder (such as, e.g., facilitating support of an existing mail stack on a feeder while concurrently supporting newly added mail stacks to the existing mail stack).

Figure 15:
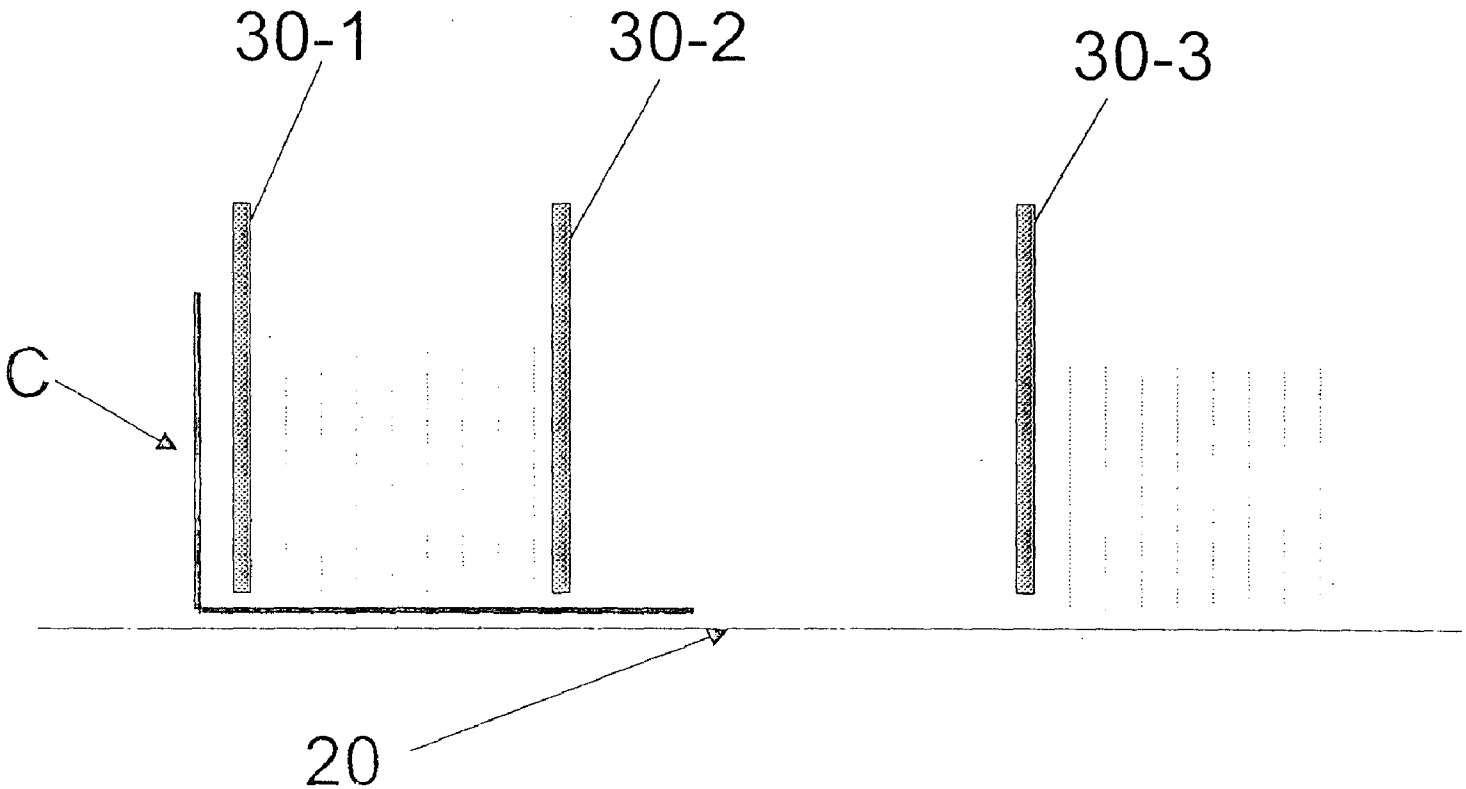
FIG. 15 is a schematic side view of an illustrative multi-pusher embodiment.

By way of example, FIG. 15 shows an illustrative embodiment in which three pushers 30-1, 30-2 and 30-3 are employed. In this illustrative embodiment, a side-by-side stack of mail (shown in dotted lines) on a carrier C (which carrier can be of any appropriate carrier design as would be understood based on this disclosure) can be supported by a plurality of pushers or paddles 30-1 and 30-2, while an existing side-by-side mail stack on a feeder is supported by at least one other pusher 30-3. Although not shown, in preferred embodiments, the right side of the side-by-side mail stack on the feeder can be supported against a destacker or the like.

Preferably, each of the pushers 30-1, 30-2 and 30-3 are adapted for both fore-and-aft and up-and-down movement. This movement can be effected, by way of example, using similar drive devices as described above for certain pusher 30 embodiments. In some embodiments, using multi-pushers can allow the mail to be slid off of a carrier by the pushers rather than requiring the carrier to be moved away to effect the same (e.g., the pushers 30-1 and/or 30-2 can be used to move the mail from the carrier).

Preferably, once the carrier C is empty and the pushers move the mail to a position such that the pushers 30-2 and 30-3 are adjacent each other or contact each other, the pushers 30-2 and 30-3 are lifted together from the existing mail stack. Then, the pusher 30-1 can move along and function in a similar capacity that the pusher 30-3 did in the prior cycle or the pusher 30-3 can move behind the mail stack and the pusher 30-1 can be removed. Thereafter, the remaining pushers can be used to slide mail off of a subsequent carrier.

Bundled-Mail Embodiments

Figure 16:
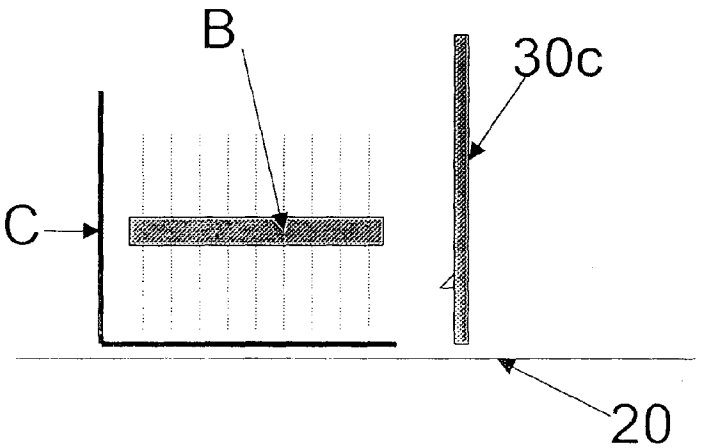
FIG. 16 is a schematic side view of an illustrative bundled mail embodiment.

While in some preferred embodiments, the mail is delivered to the feeder in a non-bundled state, in some preferred embodiments, the mail can be delivered in a bundled state, such as, e.g., as shown in FIG. 16. In this illustrative embodiment, the mail (shown in dotted lines) includes a strap B or the like wrapped around it to create a bundle of mail. In some embodiments, this strap could actually be placed on the mail by a preparation operator OpP or the like to facilitate handling of the mail being automatically fed at the feeder. In some embodiments, an automatic cutter is employed to cut the straps. In some embodiments, a modified pusher 30*c* can be provided that includes a cutter c located proximate a lower end thereof. In this manner, the pusher can preferably cut the straps during operation (such as, e.g., when removed from the mail stack). In some embodiments, the cut straps can be automatically removed and/or an operator can assist in the removal of such straps. In some embodiments, straps B could be employed instead of having carriers with front retaining walls. That is, the straps can be used to support the mail during transport in some embodiments.

Slump Inhibiting Embodiments

Figure 17:
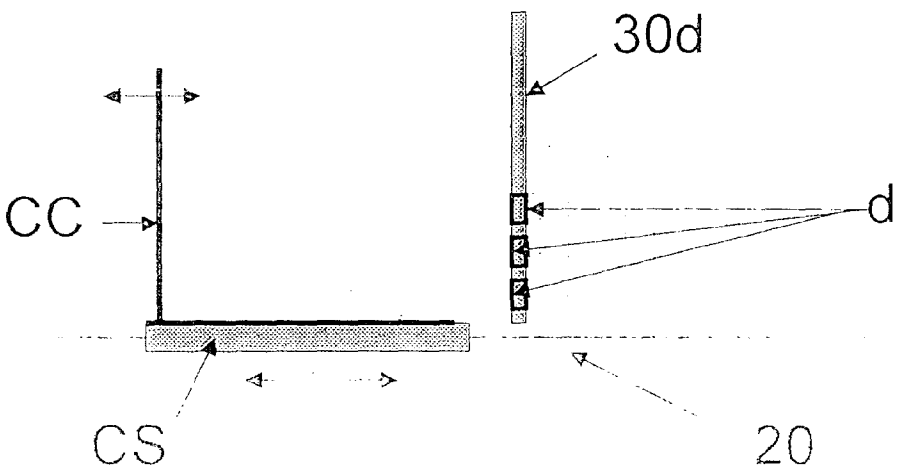
FIG. 17 is a schematic side view of some illustrative embodiments for inhibiting slump.

FIG. 17 illustrates features that can be employed in some illustrative embodiments. In this regard, a modified pusher 30*d* can be employed that includes sensors or detectors d on a rear side (e.g., facing a new stack of mail on a carrier CC to be added to the existing mail stack in process on the transporter 20). The sensors or detectors preferably include a plurality of sensors, but could potentially include a single sensor or detector. A variety of sensors or detectors could be used, such as, e.g., pressure sensors, proximity sensors and/or various other sensors or detectors.

Among other things, the detectors d can be used to help reduce forward and/or backward slump of mail that can occur in the event that excess space is present in the carrier CC. For example, upon the simultaneous removal of a carrier front wall and lifting of the pusher, excess space can result in slumped mail (see, e.g., illustrative slump shown in FIG. 17).

In some preferred embodiments, the front wall is moved, removed or not present prior to removal of the pusher. Then, when mail slumps against the pusher, the carrier C position can be adjusted (or other means can be employed, such as, e.g., another pusher [not shown]) to move the mail towards the pusher to reduce or remove the slump in the mail. In the illustrated embodiment, sensors or detectors d can be used to determine when the mail is properly positioned against the pusher (such as, e.g., when an even pressure is applied against the rear of the pusher). While detectors or the like can be provided on the pusher, it is contemplated that detectors can be located in a variety of other locations as desired. Additionally, in some embodiments, the mail can be moved forward until a particular torque or force characteristic is achieved (e.g., based on experiment or the like, a torque value, a change in torque, and/or a force value on a drive mechanism [such as, e.g., a servo-motor or the like] can be used to identify proper mail orientation). In some embodiments, as illustrated in FIG. 17, a carrier CC can include a mechanism to enable relative movement between a rear wall (e.g., to push the mail stack on the carrier) and mail supporting surface (e.g., such as a floor of the carrier) as a carrier support CS is moved towards the pusher to accommodate for excess space in the carrier. In some embodiments, another pusher (not shown) could be used to push mail out of the carrier towards the pusher 30*d*.

Removable Door Embodiments

In some embodiments, rather than pivoting away from the carrier and/or otherwise being movably attached to the carrier, a front wall of the carrier can be entirely detachable or removable. In such embodiments, a mechanism is preferably provided to a) replace the door upon the same carrier it was removed from (such as, e.g., prior to returning the empty carrier) or b) forwarding the removable door to a common return location for replacement on other carriers. In some embodiments, the doors can be manually removed and/or replaced. However, in preferred embodiments, the doors would be automatically removed and/or replaced.

In some preferred embodiments, the removable doors can have dimensions within a range of mail being processed by the feeder (such as, e.g., comparable to flats mail sizes) and/or within a range capable of being handled by the mail processing equipment. For example, in some embodiments, a substantially planar door CRD (shown in FIG. 18) can be supported in grooves on left, bottom and right sides of the carrier and a mechanism can be provided to release the door from the carrier (such as, e.g., upon contacting the pusher or other member).

Figure 18:
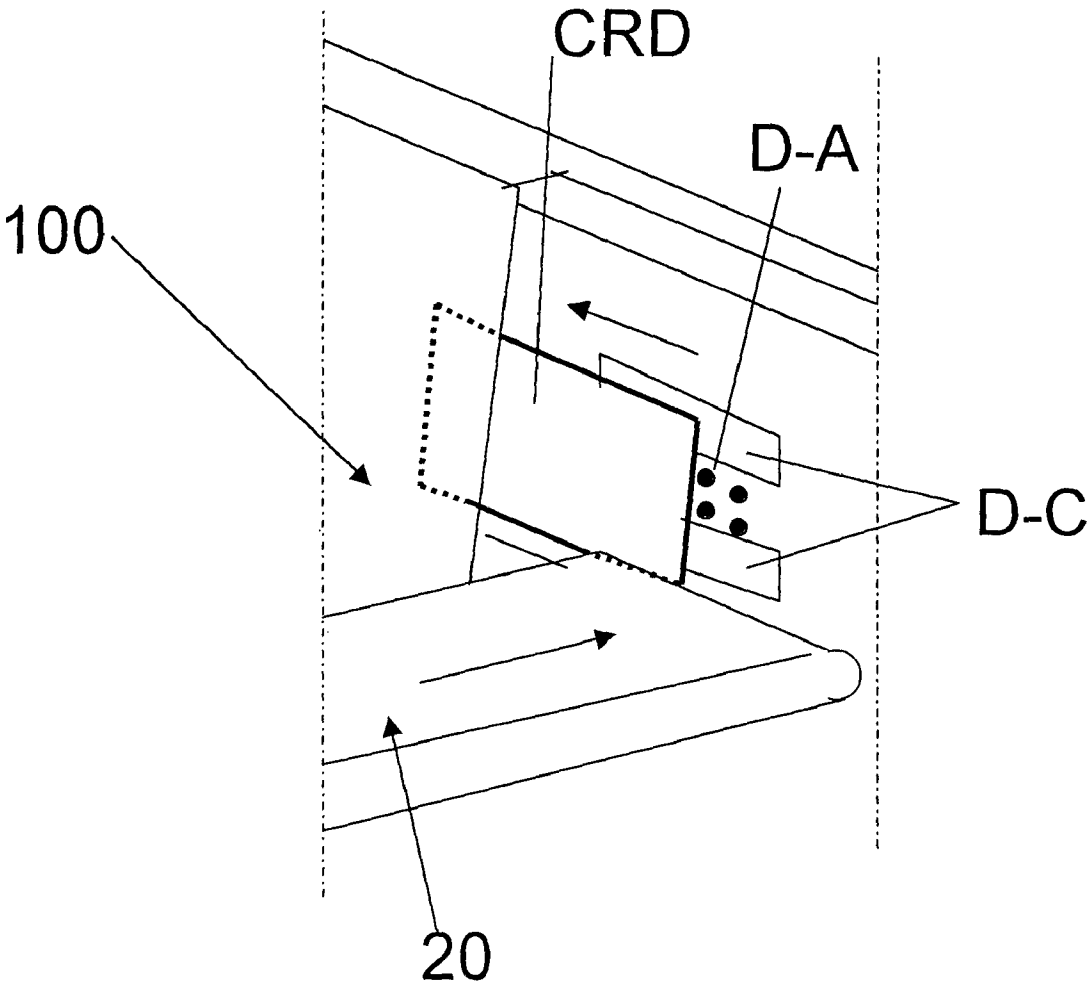
FIG. 18 is a perspective view of a portion of a system with a removable carrier door upon an illustrative destacker.

In some preferred embodiments, the released door can be supported within the side-by-side mail stack on the feeder (e.g., along with other mail in the mail stack). Then, the carrier release door CRD can preferably be singulated or destacked at a destacker. For example, FIG. 18 illustrates an illustrative carrier release door CRD after entry into an illustrative and non-limiting destacker. In this illustrative and non-limiting example, the destacker includes one or more lateral conveyors D–C and may include suction ports D–A to apply intermittent suction to items (e.g., mail) to be singulated or destacked. In this illustrative and non-limiting embodiment, the singulated items are laterally conveyed (see arrow pointing left). Once the carrier release door CRD is removed and delivered via the destacker, the door CRD can preferably be conveyed via the mail processing system to a particular location for automatic and/or manual replacement onto carriers. For example, in some embodiments, the doors can be automatically replaced onto carriers prior to a preparation operator's filling of the carriers. In some embodiments, the preparation operators can themselves manually replace the removable doors. In some embodiments, the doors can include bar coding or the like to enable scanning and/or other identification of the doors within the system (e.g., using existing address reading equipment).

Figure 19:
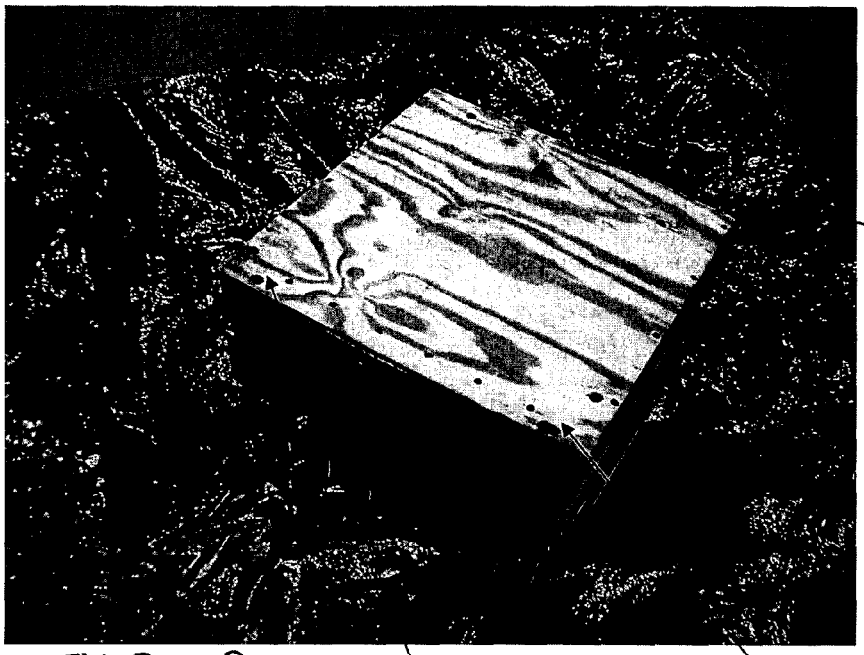
FIG. 19 is a perspective view of an alternate embodiment of a carrier, containing alternating raised and lowered surface areas of a bottom wall.

FIG. 19 illustrates another preferred embodiment of the carrier 160, wherein the carrier contains a position registration mechanism. As shown in the example of FIG. 19, the registration mechanism can be implemented by providing location holes 191, location slots 193, or any combination thereof, in the bottom surface of the carrier 160. The position registration mechanism is registered with a corresponding position registration mechanism on the carrier support bracket CS (see FIGS. 3 and 10(B)).

According to one preferred embodiment as shown, one hole 191 and one slot 193 are provided near an edge of the bottom surface of the carrier, with corresponding locating pins being provided on the carrier support bracket CS. However, the mechanisms could be placed at various locations on the carrier to achieve the desired attributes. One such attribute is to ensure proper alignment and positioning of the carrier on the carrier support CS (see FIGS. 3 and 10(B), so that the forked or tined paddle 30 (see FIGS. 11(C)) and 13) may properly interface with the grooved and/or tined surface of the carrier 160 as shown in FIG. 13. Another desired characteristic is to provide a positive engagement force between the carrier and the carrier support bracket to ensure that the force generated during the retraction step of the feeder load cycle (e.g., as shown in FIG. 9) is transferred to the carrier. In a preferred embodiment, the locating pins that mate to the position registration holes/slots are tapered. The taper facilitates proper location of the carrier on the carrier support bracket as the carrier is lowered or otherwise brought into contact with the carrier support bracket. The locating pins and vertical walls of the carrier support bracket act together to ensure proper positioning of the carrier in the x-y direction. Use of a slot allows the retracting force for the carrier to be more evenly distributed. According to one preferred embodiment as shown in FIG. 19, a hole/slot combination is provided as the slot allows for greater machine tolerance, and a second hole is not required for proper position registration of the carrier with respect to the paddle.

Figure 20:
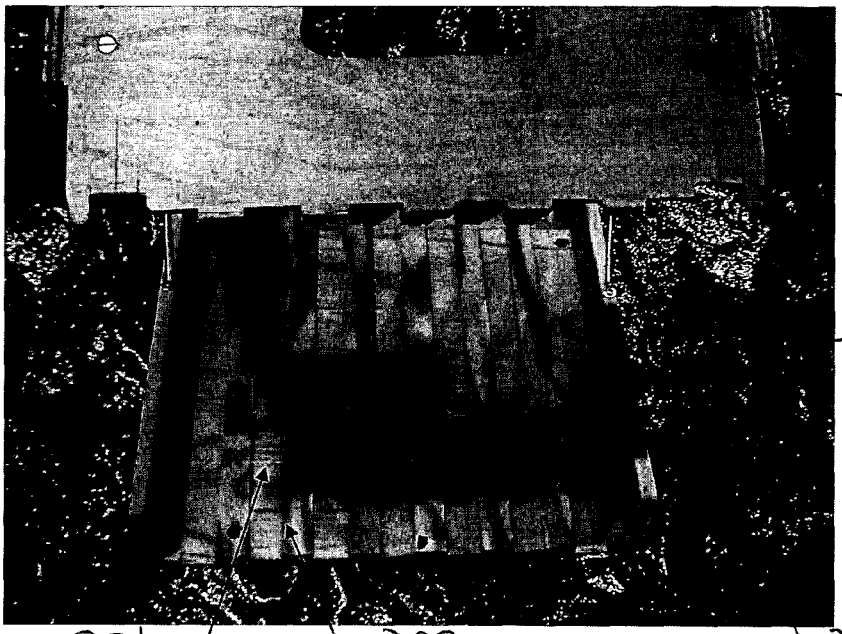
FIG. 20 is a perspective view of an alternate embodiment of a removable carrier door having a plurality of teeth that overlap a front surface of a bottom wall of a carrier.

FIG. 20 illustrates an additional optional feature of the invention, wherein alternate raised and lowered surface areas 201 and 203 are provided in the bottom panel of the carrier. The raised and lowered surfaces are aligned with the recesses in the back wall of the carrier, and also are aligned with the tines of the paddle. These areas may be provided by various alternate forms, such as, for example, in the form of alternating raised strips which are located on a flat bottom surface, or may be provided in the form of alternate raised strips and lowered recesses in the bottom surface.

The raised surfaces provide support for the flats loaded into the carrier, and the lowered surfaces allow the ends of the paddle tines to be positioned below the lowest supported mail edge during the retraction of the carrier from the stack in the feeder load cycle. This feature prevents flats from being pulled into the space between the ends of the paddle tines and the bottom surface of the carrier during carrier retraction, and possibly damaged.

Also shown in FIG. 20 are a plurality of teeth 205 provided on the bottom edge of the carrier front wall. The teeth 205 correspond to the raised and lowered surfaces of the bottom wall of the carrier to provide a positive overlap of the teeth 205 with respect to the front edge of the bottom wall of the carrier. This positive overlap prevents mail from possibly sliding into the junction between the front wall and the bottom wall of the carrier.

Other Objects

While the preferred embodiments pertain to systems for handling mail and the most preferred embodiments pertain to systems for handling mail flats, various embodiments of the invention can be used for handling all types of thin objects. The terminology "thin objects" includes all types of generally thin articles that are capable of being aligned in a side-by-side manner or stacked (i.e., the terminology "stacked" herein includes, among other things, a side-by-side relationship). In certain preferred embodiments, a given system may handle a multitude of thin objects with different sizes, compositions, flexibilities (such as, e.g., substantially rigid, substantially flexible, etc.) and/or shapes at a given time. However, in the most preferred embodiments, the thin objects preferably fall within a predetermined range of characteristics. For example, in certain preferred embodiments, the system can be adapted to handle mail flats having one or more of the characteristics described in the above-referenced co-pending applications, the entire disclosures of which have been incorporated herein by reference. While some preferred embodiments involve the handling of flats having characteristics as detailed above, numerous other embodiments can be employed having various other flat configurations or specifications, such as, e.g., that disclosed in the '311 patent. The foregoing illustrative embodiments do not limit the broad applicability of the invention to various objects having other characteristics, which may vary widely depending on the particular circumstances.

Broad Scope of the Invention

While illustrative embodiments of the invention have been described herein, the present invention is not limited to the various preferred embodiments described herein, but includes any and all embodiments having modifications, omissions, combinations (e.g., of aspects across various embodiments), adaptations and/or alterations as would be appreciated by those in the art based on the present disclosure. The limitations in the claims are to be interpreted broadly based the language employed in the claims and not limited to examples described in the present specification or during the prosecution of the application, which examples are to be construed as non-exclusive. For example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure or step are not recited.

What is claimed is:

1. A system for automated loading of a side-by-side stack of thin objects to a thin-object feeder, comprising:

a) a transporter having a transport surface upon which a side-by-side stack of thin objects can be conveyed;

b) a carrier, configured to carry a side-by-side stack of thin objects, supported above said transport surface, said carrier being in the form of a generally rectangular container comprising four walls, a floor (160FL), a left pivot (160P) and a right pivot (160P), said four walls including a front wall (160FR) extending along a first end of the floor, a back wall (160B) opposite the front wall and extending along a second end of the floor, a right wall (160R) extending along a first side of the floor, and a left wall (160L) opposite the right wall and extending along a second side of the floor, wherein said four walls and said floor define a space for receiving said stack of thin objects, and wherein said front wall, at least a portion of the left wall and a portion of the right wall are moveable together about said pivots and are movable relative to said floor;

c) a pusher supported above said transport surface;

d) said pusher and said carrier being movable relative to one another between a first position in which said pusher is inside said carrier behind a side-by-side stack of thin objects on said carrier and a second position in which said pusher is laterally displaced from said carrier, such that the side-by-side stack of thin objects on said carrier is laterally slidable off of said carrier by said pusher.

2. The system of claim 1, wherein said thin objects include mail.

3. The system of claim 2, wherein said mail includes mail flats.

4. The system of claim 1, wherein said transporter includes a conveyor.

5. The system of claim 4, wherein said conveyor includes at least one conveyor belt.

6. The system of claim 1, further including independent drive mechanisms for said pusher and said carrier, wherein said carrier is driven in a fore-and-aft direction via a carrier support, and wherein the drive mechanism for the pusher includes a fore-and-aft drive component and an up-and-down drive component, and said pusher is movable into said carrier to engage thin objects therein.

7. The system of claim 1, further including at least one controller that controls said transporter and said pusher to change relative speeds of movement based on a detected stack error.

8. The system of claim 6, further including at least one controller that controls a rate of at least one of said drive mechanisms.

9. The system of claim 1, wherein said carrier includes a bottom surface having a plurality of raised areas.

10. The system of claim 9, wherein said bottom surface further includes a plurality of lowered areas.

11. The system of claim 10, wherein said plurality of raised areas alternate with said plurality of lowered areas.

12. The system of claim 11, wherein said carrier includes a movable front wall having a plurality of teeth at a bottom edge thereof, said plurality of teeth being aligned with said alternating raised and lowered surface areas.

13. The system of claim 1, wherein the right wall includes an upper portion and a lower portion, wherein the upper portion of the right wall is separable from the lower portion of the right wall, and the left wall includes an upper portion and a lower portion, wherein the upper portion of the left wall is separable from the lower portion of the left wall.

14. The system of claim 13, wherein said upper portions are affixed to said front wall such that said upper portions are not able to move relative to the front wall, and are affixed to said floor such that said upper portions are capable of moving relative to said floor.

15. The system of claim 14, wherein said lower portions are affixed to said floor such that said lower portions are not able to move relative to the floor.

16. A method of automated loading of mail to maintain a side-by-side stack of mail on a mail feeder, comprising:

a) conveying a carrier filled with a side-by-side stack of mail to a location above said feeder, said carrier being in the form of a generally rectangular container comprising four walls, a floor (160FL), a left pivot (160P) and a right pivot (160P), said four walls including a front wall (160FR) extending along a first end of the floor, a back wall (160B) opposite the front wall and extending along a second end of the floor, a right wall (160R) extending along a first side of the floor, and a left wall (160L) opposite the right wall and extending along a second side of the floor, wherein said four walls and said floor define a space that is occupied by said stack of thin objects, and wherein said front wall, at least a portion of the left wall and a portion of the right wall are moveable together about said pivots and are movable relative to said floor;

b) laterally moving said side-by-side stack of mail and said carrier relative to one another such that the side-by-side stack of mail on said carrier is laterally slid off of said carrier and onto a transport surface of the mail feeder to a side-by-side stack of mail on the feeder.

17. The method of claim 16, further including laterally moving said side-by-side stack of mail with a pusher towards a mail stack processing location of the mail feeder.

18. The method of claim 17, further including conveying another carrier filled with a side-by-side stack of mail to a position adjacent the side-by-side stack of mail at the mail stack processing location.

19. The method of claim 18, further including raising the pusher and then moving said pusher to a position within said another carrier adjacent the side-by-side stack of mail in said another carrier.

20. The method of claim 16, wherein said laterally moving said side-by-side stack of mail and said carrier relative to one another such that the side-by-side stack of mail on said carrier is laterally slid off of said carrier includes laterally moving said carrier while a pusher is engaged with a rear of said side-by-side stack of mail.

21. The method of claim 16, wherein said laterally moving said side-by-side stack of mail and said carrier relative to one another such that the side-by-side stack of mail on said carrier is laterally slid off of said carrier includes laterally moving said side-by-side stack of mail in a direction of the feeder.

22. The method of claim 21, further including laterally sliding said mail from said carrier down a transfer slide.

23. The method of claim 17, further including controlling the transport surface and the pusher to change relative speeds of movement based on a detected stack error.

24. The method of claim 16, wherein the right wall includes an upper portion and a lower portion, wherein the upper portion of the right wall is separable from the lower portion of the right wall, and the left wall includes an upper portion and a lower portion, wherein the upper portion of the left wall is separable from the lower portion of the left wall.

25. The method of claim 24, wherein said upper portions are affixed to said front wall such that said upper portions are not able to move relative to the front wall, and are affixed to said floor such that said upper portions are capable of moving relative to said floor.

26. The method of claim 25, wherein said lower portions are affixed to said floor such that said lower portions are not able to move relative to the floor.

27. A method for upgrading a mail system having a transporter upon which mail is supported for movement and a pusher against which mail is supported during movement, wherein said pusher and said transporter are originally connected to move synchronously via the same drive mechanism, comprising:

a) providing a carrier support adapted to move above said transporter;

b) replacing the single drive mechanism with independent drive mechanisms for the transporter and the pusher, wherein the drive mechanism for the pusher includes a fore-and-aft drive component and an up-and-down drive component, and said pusher is movable to within a carrier upon said carrier support, wherein said carrier is in the form of a generally rectangular container comprising four walls, a floor (160FL), a left pivot (160P) and a right pivot (160P), said four walls including a front wall (160FR) extending along a first end of the floor, a back wall (160B) opposite the front wall and extending along a second end of the floor, a right wall (160R) extending along a first side of the floor, and a left wall (160L) opposite the right wall and extending along a second side of the floor, wherein said four walls and said floor define a space that is occupied by a stack of mail, and wherein said front wall, at least a portion of the left wall and a portion of the right wall are moveable together about said pivots and are movable relative to said floor.

28. The method of claim 27, further including controlling said drive mechanism for said pusher in response to detection by a detector.

29. The method of claim 28, further including controlling a rate of said pusher so as to change relative to a rate of said transporter.

30. The method of claim 27, wherein the right wall includes an upper portion and a lower portion, wherein the upper portion of the right wall is separable from the lower portion of the right wall, and the left wall includes an upper portion and a lower portion, wherein the upper portion of the left wall is separable from the lower portion of the left wall.

31. The method of claim 30, wherein said upper portions are affixed to said front wall such that said upper portions are not able to move relative to the front wall, and are affixed to said floor such that said upper portions are capable of moving relative to said floor.

32. The method of claim 31, wherein said lower portions are affixed to said floor such that said lower portions are not able to move relative to the floor.

* * * * *